US005893657A

United States Patent [19]

Matsuzawa

[11] Patent Number: 5,893,657

[45] Date of Patent: Apr. 13, 1999

[54] IMAGE FORMING APPARATUS WITH SHEET CONVEYING APPARATUS THAT FACILITATES JAM RECOVERY

[75] Inventor: Kunihiko Matsuzawa, Kawasaki, Japan

[73] Assignee: Canon Kabushiki Kaisha, Tokyo, Japan

[21] Appl. No.: 08/778,250

[22] Filed: Jan. 8, 1997

Related U.S. Application Data

[63] Continuation of application No. 08/651,005, May 21, 1996, abandoned, which is a continuation of application No. 08/490,577, Jun. 15, 1995, abandoned, which is a continuation of application No. 08/165,899, Dec. 14, 1993, abandoned.

[30] Foreign Application Priority Data

Dec. 28, 1992 [JP] Japan ..... 4-361206
Jan. 25, 1993 [JP] Japan ..... 5-027167

[51] Int. Cl.[6] ..... G03G 21/00

[52] U.S. Cl. ..... 399/18; 399/20; 399/21; 399/124; 399/388

[58] Field of Search ..... 399/18, 21, 20, 399/124, 388

[56] References Cited

U.S. PATENT DOCUMENTS 4,531,823 7/1985 Deguchi et al. ..... 355/308
4,873,554 10/1989 Greco, Jr. ..... 355/309

*Primary Examiner*—William Royer
*Attorney, Agent, or Firm*—Fitzpatrick, Cella, Harper & Scinto

[57] ABSTRACT

An image forming apparatus for forming an image on a sheet has a first conveyance path for guiding the sheet, and a second conveyance path arranged in continuation from the first conveyance path to guide the sheet conveyed from the first conveyance path. A conveyor drum, which may be an image transfer drum, retains the sheet on its surface and conveys the sheet such that the sheet moves along said second conveyance path. The drum and the second conveyance path are supported such that they can be moved in a direction which intersects the direction of sheet conveyance, so as to be drawn out of the main part of the apparatus. A sheet jam detector is provided for detecting a sheet jam at a predetermined position which is on the drum and which is spaced from the inlet of the second conveyance path by a distance greater than the length of the sheet which has the greatest length among the sheets which are to be handled by the apparatus, as measured along the second path. A plurality of conveying rollers located within the first and second conveyance paths are selectively rotated to ensure that a trailing end of the sheet passes the inlet of the second conveyance path. A space is provided within the second conveyance path for accommodating bulging of the sheet during that process.

49 Claims, 16 Drawing Sheets

PRIOR ART

IMAGE FORMING APPARATUS WITH SHEET CONVEYING APPARATUS THAT FACILITATES JAM RECOVERY

This application is a continuation of application Ser. No. 08/651,005 filed May 21, 1996, now abandoned, which is a continuation Ser. No. 08/490,577 filed Jun. 15, 1995, now abandoned, which is a continuation of Ser. No. 08/165,899 filed Dec. 14, 1993, now abandoned.

BACKGROUND OF THE INVENTION

1. Field of the Invention

The present invention relates to an image forming apparatus, such as a printer, a copying machine, a facsimile, etc., employing electrophotography, ink jet recording, etc.

2. Description of the Related Art

Various image forming apparatuses, such as copying machines, facsimiles and the like, form images by electrophotography, ink jet recording, etc., while conveying recording members, such as sheets of paper.

A conventional electrophotographic copying machine will be described with reference to FIG. 16.

This image forming apparatus is essentially composed of an image input section 90R and an image output section 90P. The image input section 90R inputs image information to be recorded, processes the information in various manners, and then transmits the image signals generated from the information to the image output section 90P.

The image output section 90P is essentially composed of: an image forming unit (photosensitive drum) 91 for forming an image to be recorded; a sheet feeder unit 92 for housing sheets S and feeding a sheet S one at a time; a transfer/conveyance unit 93 for receiving a sheet S from the sheet feeder unit 92, and conveying the sheet S to the image forming unit 91 while retaining the sheet S on the surface of a transfer drum, and transferring the image from the image forming unit 91 onto the sheet S; a fuser unit for fixing the image recorded on the sheet S; and a control unit 95 for controlling the operation of the entire apparatus.

The procedure of recording operation of the image forming apparatus will be described in detail.

When the recording operation is initiated, the sheet feeder unit 92 feeds one sheet S at a time. After the sheet is conveyed to a pair of register rollers 96 provided immediately upstream from the transfer/conveyance unit 93, the register rollers 96 start to rotate.

The register rollers 96 start to rotate synchronously with an image recording initiation signal, thus conveying the sheet S to the transfer/conveyance unit 93. In the transfer/conveyance unit 93, when the sheet S is further conveyed through a guide portion 93A to a transfer drum 93B, the sheet S is attached to the surface of the transfer drum 93B. While the transfer drum 93B rotates, the sheet S is conveyed to an image transfer region T, where the image formed by toner on the image forming portion is transferred onto the sheet S.

Conventional image forming apparatuses employ various methods to retain a sheet S on the surface of a transfer drum, for example: an electrostatic method in which a sheet S is electrostatically attached to a conveying medium formed of a thin dielectric film, a suction method in which a sheet S is drawn to the surface of the drum by air suction, or a combined method in which edges of a sheet S are clamped by a gripper while the sheet is electrostatically attached or drawn by air suction to the drum.

After recording has been thus performed on the sheet S, the sheet S is conveyed, as the transfer drum 93B rotates, to the vicinity of a fuser unit 94. Then, the sheet S is peeled off from the transfer drum 93. The peeling is started from the leading edge of the sheet S. While the sheet is being peeled from the transfer drum 93, the sheet S is continuously conveyed toward the fuser unit 94. The fuser unit 94 applies heat or pressure to the sheet S, thereby fixing the toner image thereon. Finally, the sheet S is ejected by a pair of ejection rollers 97 onto a tray 98 provided on the outside wall of the apparatus.

If a conveyance failure (sheet jam) occurs during the recording operation, the image forming apparatus stops the operation and indicates the conveyance failure on a display (not shown) to instruct the user to perform jam recovery, for example, by removal of the stuck sheet S.

Therefore, one of major requirements for an image forming apparatus is that the apparatus is constructed so as to facilitate jam recovery, thereby substantially eliminating the possibility that during jam recovery the user tear the stuck sheet S and leave a fragment of the sheet S in the apparatus or mistakingly damage a component part of the apparatus.

During the recording operation to the above-described image forming apparatus, conveyance failure is most likely to occur in the transfer/conveyance unit 93, because the unit 93 has a complex structure. To facilitate safe jam recovery without a failure, the transfer/conveyance unit (a portion indicated by a dotted-line box) 93 has a construction that allows the unit 93 to be drawn out from the image forming apparatus 99. A sheet S can be easily removed from the transfer drum 93B after the transfer/conveyance unit 93 has been drawn out.

When the transfer/conveyance unit 93 is drawn out, a user can more easily see a jammed sheet S and perform the sheet jam recovery than in a construction where the unit 93 cannot be drawn out and in which a user must put his/her hand into the image forming apparatus 99 to perform the sheet jam recovery. Further, the above-described construction will substantially eliminate a danger that while performing the sheet jam recovery, a user may mistakingly deform or break the conveyance medium, such as a thin film, that is retaining the sheet S.

However, even in the conventional construction that allows the transfer/conveyance unit 93 to be drawn out, it is not easy to remove a jammed sheet S if the sheet S is held by both the sheet feeder unit 92 and the transfer/conveyance unit 93.

For example, if a leading edge portion of a sheet S fails to completely attach to the attachment film of the transfer drum 93B when the sheet S is being conveyed from the register rollers 96, the leading portion of the sheet S may go into the image forming unit 91. When such a malfunction is detected, the conveyance of the sheet S must be stopped immediately in order to prevent the sheet S from damaging the image forming unit 91. When the conveyance of the sheet S is thus stopped, a rear portion of the sheet S is, often, still clamped between the register rollers 96, thus impeding sheet jam recovery as follows. If the transfer/conveyance unit 93 is drawn out of the image forming apparatus, the sheet S held by both the attachment film and the register rollers 96 will be torn, or the attachment film will be deformed or broken.

To avoid such problems, the register rollers 96 are manually rotated in the reverse direction to move back the sheet S before the sheet jam recovery is performed. However, when the register rollers 96 are rotated backward, the attachment film is pulled back along with the sheet S and receives a considerably large load because the transfer drum 93B is in contact with attaching means and cleaning means (not shown) and thereby opposes a large rotational load.

The image forming apparatus can be stopped with a sheet S held by both the register rollers 96 and the transfer/conveyance unit 93, not only when a conveyance failure is caused by the sheet S in the transfer/conveyance unit 93 but also, for example, when a conveyance failure is caused by the preceding sheet S downstream from the transfer/conveyance unit 93. Although the incidence of such a stoppage of the image forming apparatus is quite high, the conventional image forming apparatus having the above-described construction that allows the transfer/conveyance unit 93 to be drawn out lacks means for facilitating sheet jam recovery in such a stoppage. On the other hand, it is impractical to provide sheet jam recovery mechanisms respectively adapted to the individual types of sheet jams. It would increase the size and costs of the apparatus and complicate sheet jam recovery operations.

SUMMARY OF THE INVENTION

Accordingly, it is an object of the present invention to provide an image forming apparatus in which no jammed sheet will be positioned over a transfer drum portion and a sheet feeder unit and, therefore, the transfer drum portion can be drawn out without tearing the jammed sheet, thereby facilitating recovery of a sheet jam caused by a sheet on the transfer drum.

According to one aspect of the present invention, there is provided an image forming apparatus comprises: a conveyor portion for conveying a sheet fed by a sheet feeder unit; a transfer drum portion for conveying the sheet to an image forming unit while retaining the sheet on the surface thereof; and a conveyance jam detector for detecting a conveyance jam of the sheet caused on the transfer drum unit, wherein the conveyor portion and the transfer drum portion can be drawn out together, and wherein a conveyance path between the conveyance jam detector and the upstream end of the conveyor portion is longer than the length of a maximum-size sheet that can be handled by the image forming apparatus, the length being measured along the conveyance direction.

In accordance with another aspect of the present invention, there is provided a sheet conveying apparatus comprising a first conveyance path and a second conveyance path arranged downstream of the first conveyance path. A supporting means supports the second conveyance path so as to allow it to move in a direction intersecting the direction of conveyance of the sheet, and a detecting means is provided for detecting a jam of the sheet at a first predetermined position, the position being within the second conveyance path and spaced from an inlet to the second conveyance path by a distance greater than a length of the maximum size sheet.

In accordance with yet another aspect of the above invention, there is provided a sheet conveying apparatus comprising a first conveyance path and a second conveyance path arranged downstream of the first conveyance path, together with a supporting means for supporting the second conveyance path so as to allow it to move in a direction intersecting the direction of the sheet. A detecting means is positioned within the second conveyance path and there are provided first conveying means disposed proximate to the inlet to the second conveyance path and second conveying means disposed in the second conveyance path for conveying the sheet beyond the detecting means. A controller controls the first and second conveying means such that when the first detecting means has detected a jam of a sheet at a first predetermined position, the second conveying means is stopped while the first conveying means operates until a trailing end of the sheet passes the inlet to the second conveying path.

In the image forming apparatus of the invention, when a sheet jams in the transfer drum portion, the sheet is never positioned over the transfer drum portion and the sheet feeder unit, but it is always positioned in the conveyance path of the conveyor portion.

Therefore, whenever a sheet jams in the transfer drum portion, the transfer portion and the conveyor portion can be drawn out together from the image forming apparatus without tearing the sheet, thereby allowing the sheet jam recovery to be easily and unmistakably performed.

Further objects, features and advantages of the present invention will become apparent from the following description of the preferred embodiments with reference to the attached drawings.

DESCRIPTION OF THE PREFERRED EMBODIMENTS

Preferred embodiments of the present invention will be described hereinafter with reference to the drawings.

[First Embodiment]

Figure 1:
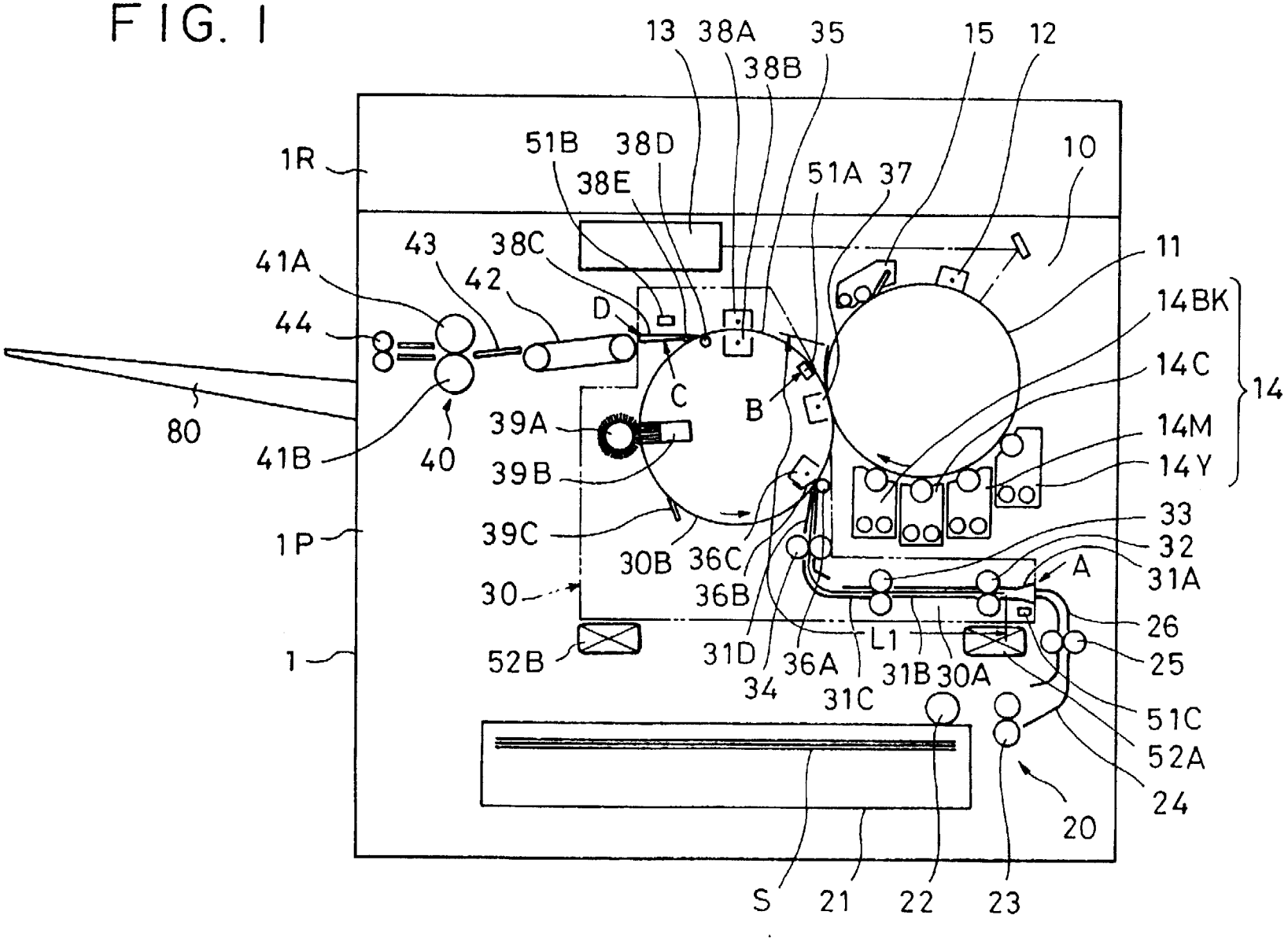
FIG. 1 is a longitudinal sectional view of first embodiment (a laser beam printer) of the image forming apparatus of the invention.

The overall construction of an image forming apparatus in accordance with first embodiment of the invention is shown in FIG. 1.

The image forming apparatus 1 is essentially composed of an image input section 1R and an image output section 1P. The image input section 1R inputs image information to be recorded, processes the information in various manners, and outputs image signals generated from the information to the image output section 1P.

The image output section 1P comprises an image forming unit 10, a sheet feeder unit 20, a transfer/conveyance unit 30, a fuser unit 40, and a control unit (not show).

The units of the image output section 1P will be each described.

The image forming unit 10 is constructed as follows. A photosensitive drum 11, a carrier of an image, is journaled at its center so as to be rotatable in the direction indicated by an arrow. A primary charger 12 an optical system 13, and a developing device 14 are sequentially arranged over the peripheral surface of the photosensitive drum 11 along the rotational direction. The developing device 14 is composed of four developer portions 14Y, 14M, 14C and 14BK containing yellow, magenta, cyan and black developing agents (toners). The developer portions 14Y, 14M, 14C and 14BK sequentially move closer to the photosensitive drum 11. A cleaning device 15 is provided downstream from an image transfer region.

An image is formed on the photosensitive drum 11 by using toner as follows. After the primary charger 12 uniformly charges the peripheral surface of the photosensitive drum 11, the optical system 13 irradiates the surface of the photosensitive drum 11 with a beam, for example, a laser beam, that is modulated in accordance with the image signals, thus forming an electrostatic latent image on the photosensitive drum 11. Then, the developing device 14 applies toners to the surface of the photosensitive drum 11, thus developing the electrostatic latent image into a visible toner image. After the toner image is transferred onto a sheet S, the cleaning device wipes off the toner remaining on the photosensitive drum The sheet feeder unit 20 comprises: a cassette 21 for housing sheets S; a pick-up roller 22 for feeding sheets one at a time out of the cassette 21; a pair of feeding rollers 23; a pair of conveying rollers 25; and feeding guides 24, 26.

The transfer/conveyance unit 30 is essentially composed of a conveyor portion 30A and a transfer drum portion 30B. The conveyor portion 30A comprises: guides 31A, 31B and 31C for guiding a sheet S from the sheet feeder unit 20; pairs of conveying rollers 32, 33; a pair of register rollers 34 for conveying a sheet S to the transfer drum portion 30B in accordance with the image forming timing of the image forming unit 10; an attaching guide 31D for leading a sheet S to the transfer drum portion 30B.

The register rollers 34 are provided with means (not shown) for automatically releasing the register rollers 34 from the pressing abutment. This means facilitates pulling out a sheet S from the nip between the register rollers 34 during a sheet jam recovery.

The transfer drum portion 30B will be next described.

Figure 3:
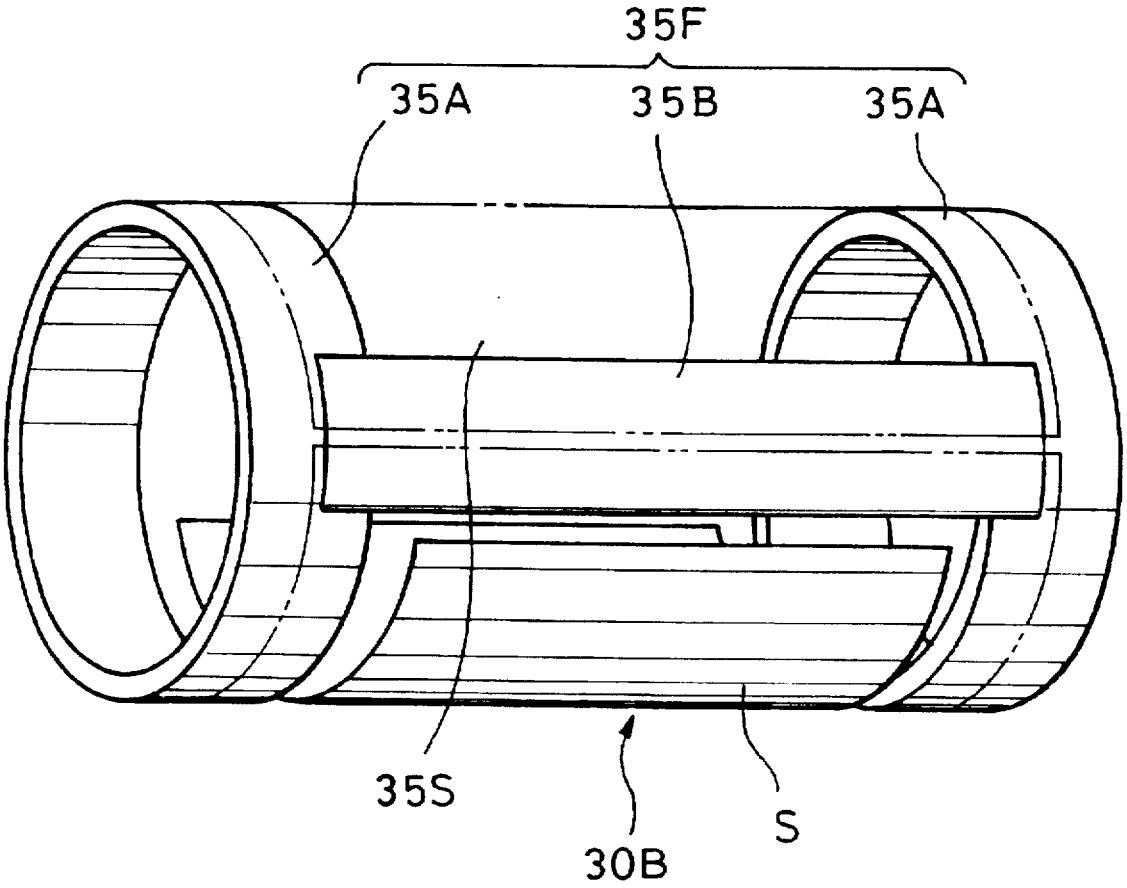
FIG. 3 is a perspective view of a transfer drum employed in first embodiment.

As shown in FIG. 3, the transfer drum 35 is essentially composed of a frame 35F and a sheet-protecting film 35S rolled on the frame 35F, thus forming a cylindrical shape of the drum 35. The frame 35F is essentially composed of annular members 35A forming both ends of the drum 5, and a connector member 35B connecting the annular members 35A. The sheet-protecting film 35S has been formed of, for example, PET (polyethylene terephthalate) or PVdF (polyvinylidene fluoride).

Referring back to FIG. 1, an attaching roller 36A is provided at a position where the sheet S from the register roller 34 abuts the transfer drum 35. The attaching roller 36A is supported so that it can be placed in and out of the contact with the transfer drum 35. A back-up member 36B for bearing the pressing force of the attaching roller 36A and an attaching charger 36C are arranged inside the transfer roller 35 but adjacent to the attaching roller 35, in other words, across the film 35S from the attaching roller 35.

In the image transfer region, where the transfer drum 35 faces or contacts the photosensitive drum 11, a transferring charger 37 is provided inside the transfer drum 35, adjacent to the film 35S. Discharging chargers 38A, 38B are arranged outside and inside transfer drum 35, respectively, downstream from the image transfer region. A separator for separating a sheet S from the transfer drum 35 is provided adjacent to the discharging chargers 38A, 39B. The separator comprises a separating blade 38C, a deforming roller 38D' positioned inside the transfer drum 35, and a deforming roller 38E positioned outside the transfer drum 35.

Provided further downstream the rotational path of the transfer drum 35 are: a brush roller 39A for cleaning the sheet retaining surface of the film 35S; a corona discharger or a brush charge eliminator 39B; and a scraper 39C for cleaning the non-image area of the surface of the film 35S.

The transfer drum 35 is constructed so as to be placed in and out of the contact with the photosensitive drum 11. Because the transfer drum 35 is in contact with photosensitve drum 11 only during normal operations, an unnecessarily long-time contact between the two drums 35, 11 can be avoided. In addition, because, as implied above, the transfer drum 35 is positioned apart from the photosensitive drum 11 during a sheet jam recovery, the surface of the photosensitive drum 11 is protected from damages that could be caused by, for example, contact with the sheet S, during the recovery.

The transfer/conveyance unit 30, enclosed in an imaginary dotted line in the figure, can be drawn out from the main body of the image forming apparatus 1 by using sliders 52A, 52B. Thereby, the sheet jam recovery and maintenance of the transfer drum portion 30B can be easily performed without a failure.

Figure 2:
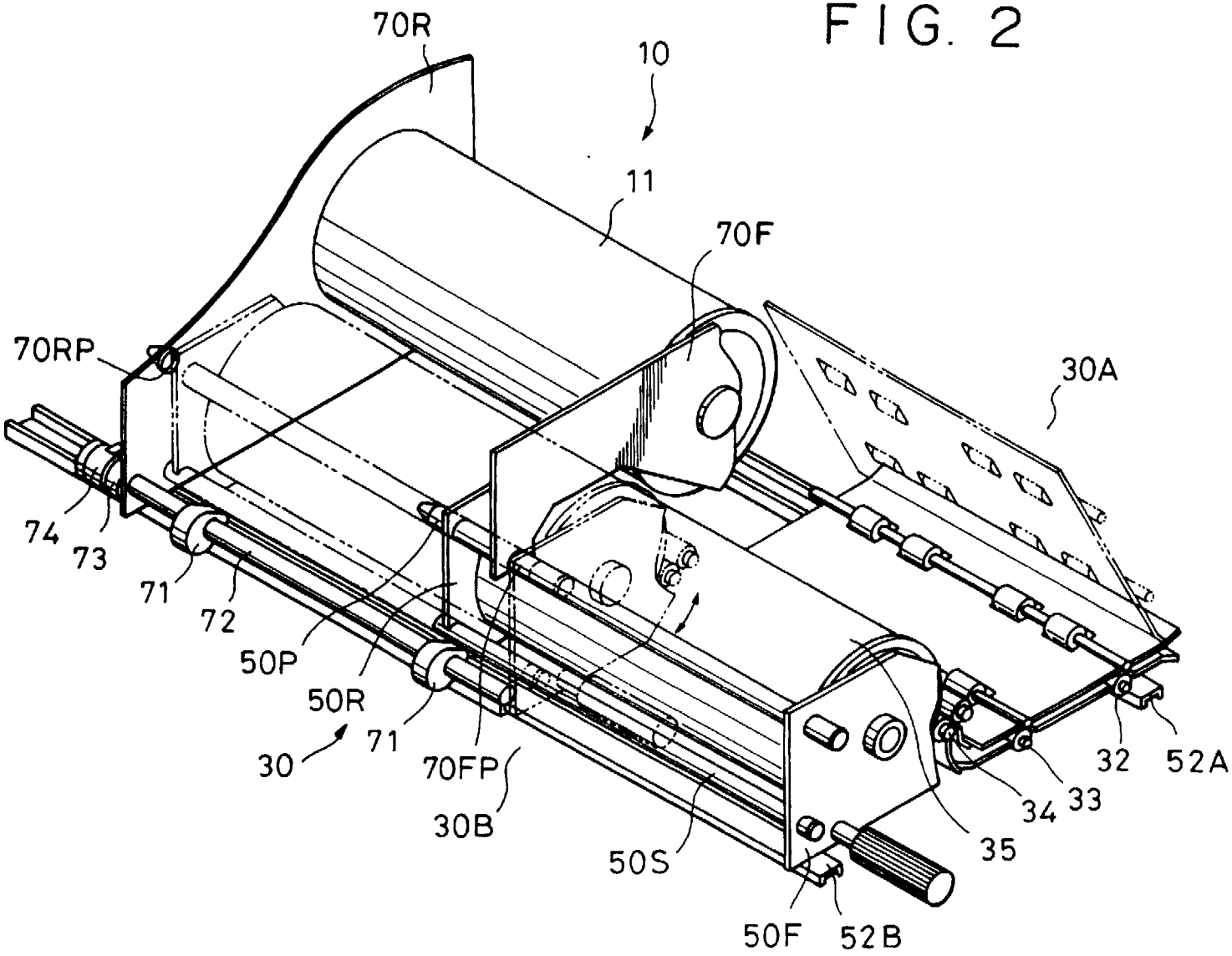
FIG. 2 is a perspective view of transfer/conveyance unit employed in first embodiment.

The construction of the transfer/conveyance unit 30 will be further described in detail with reference to FIG. 2.

The transfer drum 35 is rotatably supported by a unit frame composed of a unit front plate 50F, a unit rear plate 30R, a positioning shaft 50P, a stay shaft 50S, etc. The transfer/conveyance unit 30 is positioned to the image forming apparatus 1 by fitting the positioning shaft 50P into a positioning recess of a front plate 70F and a positioning hole 70RP of a rear plate 70R of the main body of the image forming apparatus 1.

A cam shaft 72 having cams 71 is rotatably disposed in the main body of the image forming apparatus 1. As shown in the figure, the cam surfaces of the cams 71 contact the stay shaft 50S (although not shown, the stay shaft 50S is urged toward the cams 71). The cam shaft 72 is firmly connected at an end thereof to a gear 73 and a spring clutch 74 for transmitting driving torque from the main body of the image forming apparatus 1. By the cooperation of the gear 74, the spring clutch 74 and a plunger (not shown), the cams 71 are selectively rotated by 180° and thus held in two different positions.

By the above-described rotation of the cams 71, the stay shaft 50S is pushed and, thus, the transfer/conveyance unit 30 pivots about the positioning shaft 50P. In accordance with the two positions of the cams 71, the transfer/conveyance unit 30 assumes two different positions: a position (operational position) in which the transfer drum 35 is adjacent to the photosensitive drum 11, and a position (withdrawn position) in which the transfer drum 35 is apart from the photosensitive drum 11. Although not shown, a stopper is provided for allowing the transfer/conveyance unit 30 to be drawn out from the main body of the image forming apparatus 1 only when the transfer/conveyance unit 30 is placed in the withdrawn position, thereby eliminating the danger of the two drums 35, 11 contacting and damaging each other when the transfer/conveyance unit 30 is drawn out.

The fuser unit 40 comprises: a pair of fixing rollers constituting a fusing roller 41A containing a heat source, such as a halogen heater, and a pressure roller 41B (which may also contain a heat source) for pressing against the fusing roller 41A; a conveyor belt 42 for leading a sheet S to the nip of the fixing rollers 41A, 41B; a pair of sheet ejecting rollers 44 for ejecting the sheet S from the fixing rollers 41A, 41B out of the image forming apparatus 1.

The control unit (not show) comprises a motor drive circuit board and a control circuit board for controlling the operations of the individual mechanisms of the above-described units.

The image forming operation of the image forming apparatus 1 will be described hereinafter.

When an image formation initiation signal is outputted, the transfer drum portion 30B is pivoted to the operation position and, then, the transfer drum 35 rotates synchronously with the photosensitive drum 11. Simultaneously, the pick-up roller starts to feed sheets S one at a time from the cassette 21. The sheet S is conveyed to the conveyor portion 30A by means of the feeding rollers 23, conveying rollers 25 and feeding guides 24, 26.

In the conveyor portion 30A, the sheet S is conveyed to the register rollers 34 by means of the conveying rollers 32, 33 and sheet guides 31A, 31B, 31C. The register rollers 34 have not started to rotate when the leading edge of the sheet S reaches and abuts the nip of the register rollers.

The register rollers 34 start to rotate a predetermined length of time after the image forming unit 10 has started forming an image on the photosensitive drum 11. The rotation initiation timing of the register rollers 34 is predetermined so that the sheet S will coincide with the toner image formed on the photosensitive drum 11 in the image transfer region.

When the leading edge of the sheet S abuts the transfer drum 35, the sheet S is electrostatically attached to the sheet-protecting film 35S due to the corona discharge of the attaching charger 36C and the operation of the attaching roller 36A (the attaching roller 36A is pressingly contacted with the transfer drum 35 only when the sheet S has reached the transfer drum 35, and the attaching roller 36A is positioned apart therefrom during other occasions in order to reduce the load). Because the transfer drum 35 is rotated synchronously with the photosensitive drum 11, the sheet S is conveyed to the image transfer region while being attached to the transfer drum 35. In the image transfer region, the image formed on the photosensitve drum 11 by the above-described process is transferred to the sheet S by means of the transfer charger 37. Then, the sheet S is further conveyed to the separator.

In mono-color recording, the sheet S is separated from the transfer drum 35 by the operation of the separator as described below. However, in multi-color recording, the sheet S is left attached to the transfer drum 35 and conveyed again to the image transfer region because one rotation of the transfer drum 35 is needed for the transfer of an image of one color. Thus, another image of a different color is transferred to the sheet S carrying the previously-transferred image. Such a transfer step is repeated as required. During the transfer process, the brush roller 39A and the like, which are supported so that they can be placed in and out of the contact with transfer drum 35, are positioned apart from the transfer drum 35.

Figure 4A:
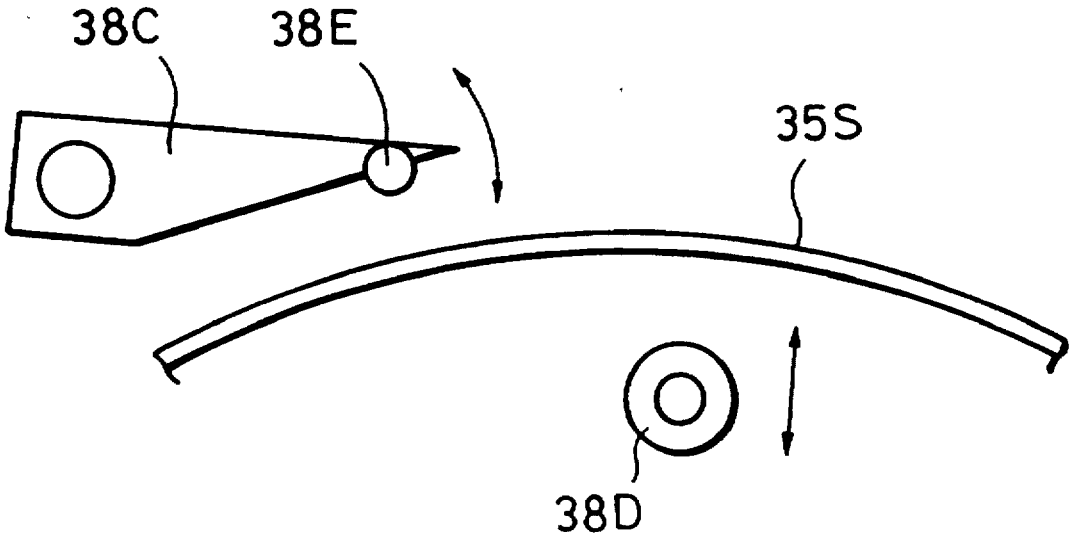
FIGS. 4(*a*) and 4(*b*) are longitudinal sectional views in part of the transfer drum, illustrating the separation of a sheet from the drum.
Figure 4B:
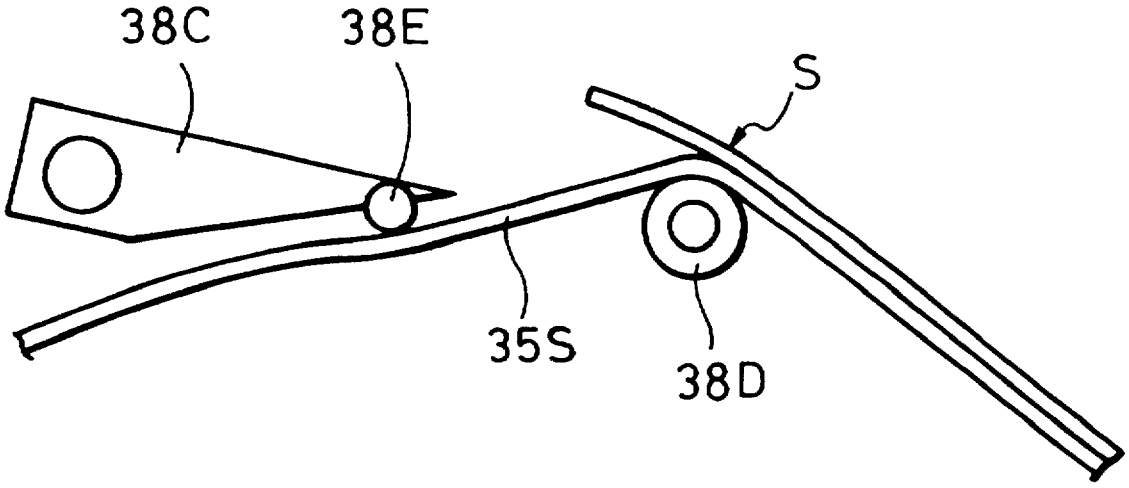

When the sheet S has received the prepared image, the separator separates the sheet S from the transfer drum 35 as follows. After the discharging chargers 38A, 38B reduce the attaching force between the sheet S and the film 35S, the separating blade 38C and the deforming rollers 38D, 38E cooperate to separate the sheet S from the transfer drum 35, as illustrated in FIGS. 4(*a*) and 4(*b*). When the leading edge of the sheet S approaches the separator, the inside and outside-disposed deforming roller 38D, 38E move from the positions as indicated in FIG. 4(*a*) to the positions as indicated in FIG. 4(*b*) to push (deform) the film S outwards and inwards, respectively. Because the curvature of the film 35S is locally increased by the deforming rollers 38D, 38E, the sheet S separated from the film 35S.

The sheet S thus separated from the transfer drum 35 is conveyed to the pair of fixing rollers (the fusing roller 41A and the pressure roller 41B) by the conveyor belt 42. The guide 43 precisely guides the sheet S to the nip portion of the fixing rollers 41A, 41B. The toner image is fixed to the sheet S by heat from the fusing roller 41A and by pressure from the pressure roller 41B. Then, the ejecting rollers 44 eject the sheet S onto a tray 80 provided on the outside of the image forming apparatus 1.

When image formation has been performed on a preset number of sheets S, the transfer drum portion 30B is moved back to the withdrawn position. The image forming apparatus 1 thus completes the image forming operation.

During the image forming operation, the image forming apparatus 1 may experience a sheet conveyance failure as follows.

When a sheet S from the register rollers 34 reaches the vicinity of the attaching roller 36A, the attaching charger 36B and the like provided adjacent to the film 35S (FIG.3) of the transfer drum 35, a leading portion of the sheet S may fail by chance to firmly attach to the film 35S.

If a leading portion of a sheet S reaches the transfer region while it is not completely attached to the film 35S, the leading portion is drawn to the photosensitive drum 11 by the electrostatic charges on the surface of the photosensitive drum 11. Thus, the sheet S is separated from the transfer drum 35 and drawn to the photosensitive drum 11 in the transfer region as the transfer drum 35 and the photosensitive drum 11 rotate together. If the operation continues, the sheet S is forced into the cleaning device 15, damaging the cleaning blade, the surface of the photosensitive drum 11 or the like. Furthermore, it will be difficult to remove the thus-jammed sheet S.

To prevent such trouble, the image forming apparatus 1 of this embodiment has a transfer-portion sheet-jam detector 51A positioned inside the transfer drum 35, adjacent to the transfer region. The transfer-portion sheet-jam detector 51A optically detects the presence of a sheet S attached to the film 35S. If the transfer-portion sheet-jam detector 51A does not detect a sheet S at a predetermined timing, it is determined that the sheet has been drawn to the photosensitive drum 11.

The above reference to "a predetermined timing" means, for example: a predetermined length of time after the pick-up roller 22 starts rotating to feed a sheet S, the predetermined length of time allowing the leading edge of the sheet S to reach the vicinity of the transfer-portion sheet-jam detector 51A; or a predetermined length of time after a sheet sensor provided upstream from the transfer-portion sheet-jam detector 51A senses that the leading edge of a sheet S passes by, the predetermined length of time allowing the leading edge thereof to reach the vicinity of the transfer-portion sheet-jam detector 51A.

Figure 5:
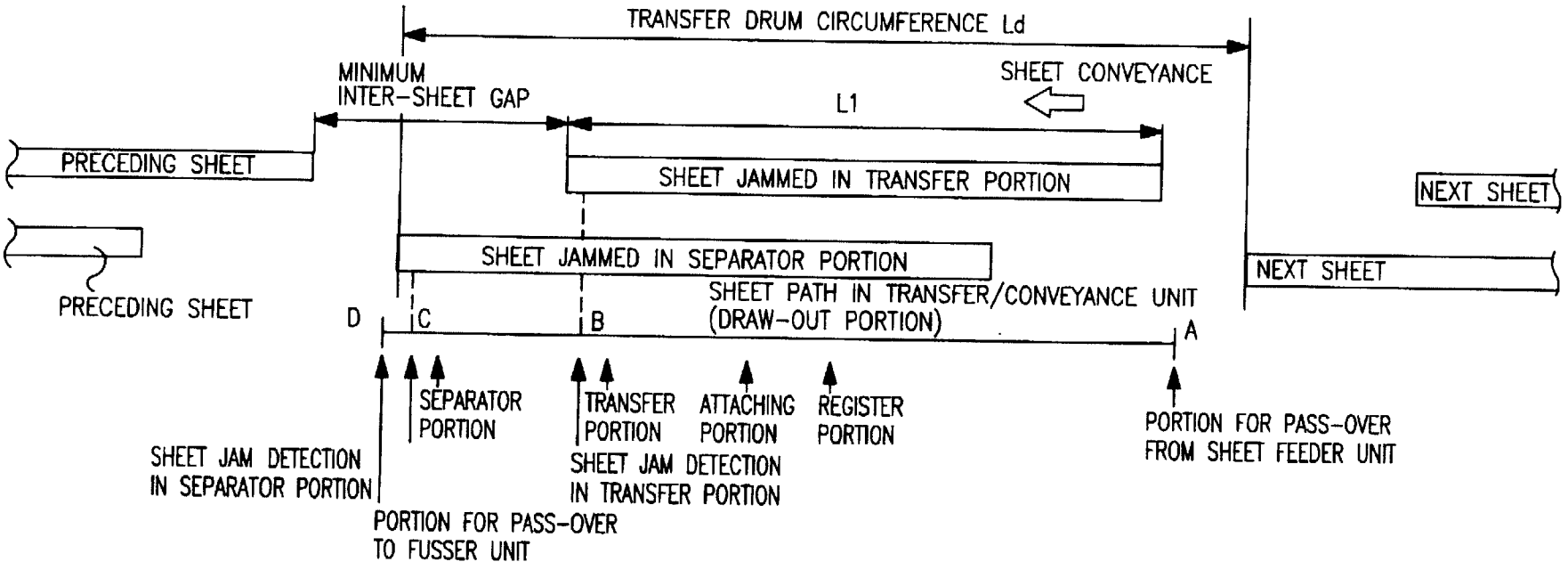
FIG. 5 schematically illustrates the stop positions of a sheet when a sheet jam occurs in Embodiment 2 of the image forming apparatus of the invention.

In addition, as indicated in FIG. 5, the path AB between the upstream end (position A) of the conveyor portion 30A and the transfer-portion sheet-jam detector 51A (position B) in the conveyance path of the transfer/conveyance unit 30 (which can be drawn out from the main body of the apparatus) is longer than the length L1 of a maximum-size sheet that can be handled by the image forming apparatus, the length L1 being measured along the sheet conveyance direction. In this construction, when a sheet S is jammed in the transfer/conveyance unit 30, the sheet S will be positioned inside the transfer/conveyance unit 30, not over the transfer/conveyance unit 30 and the sheet feeding unit 20, thereby eliminating the danger that a jammed sheet S will be torn when the transfer/conveyance unit 30 is drawn out.

Further, a sheet jam may also occur in the vicinity of the separator provided adjacent in the transfer drum portion 30B. The image forming apparatus 1 has a separator sheet-jam detector 51B provided above the separating blade 38C. If the separator sheet-jam detector 51B does not detect a sheet S a predetermined length of time after the separator has started separating the sheet S from the transfer drum 35, the apparatus 1 determines that a sheet jam has occurred.

Next described will be the operation performed when a sheet conveyance failure (sheet jam) occurs.

If the transfer-portion sheet-jam detector 51A detects a sheet jam, the image forming apparatus 1 immediately stops sheet conveyance, thereby preventing the sheet S from being forced into the cleaning device 15. Simultaneously, the transfer drum 35 is shifted back to the withdrawn position. The register rollers 34 are released from the pressing abutment therebetween, and the attaching roller 36A is shifted away from the transfer drum 35. Then, a message indicating the conveyance failure is displayed in the display unit (not shown), instructing the user to perform sheet-jam recovery.

The user opens the front cover of the image forming apparatus 1 and draws out the transfer/conveyance unit 30 therefrom. As discussed above, the entire length of the jammed sheet S is inside the transfer/conveyance unit 30. More specifically, the leading edge of the sheet S is slightly downstream of the transfer-portion sheet-jam detector 51A because it takes a short time to completely stop sheet conveyance after a sheet jam has been detected. The tail edge of the sheet S is inside the conveyor portion 30A even if the sheet S is of the maximum size. Therefore, when the transfer/conveyance unit 30 is drawn out, the entire sheet S will come out together with the transfer/conveyance unit 30.

The sheet S can be removed from the transfer/conveyance unit 30 as follows. The user draws the sheet S upward by holding a leading portion thereof, which is apart from the transfer drum 35. Although the sheet S is clamped by the conveying rollers 32, 33, the sheet S can be easily drawn because, for example, the rollers 32, 33 are provided with one-way clutches that allow the rollers to rotate in the direction in which the sheet S is pulled. Optionally, the conveyance rollers 32, 33 and the sheet guide 31A may be constructed so as to allow the upper portions thereof to be opened upward as shown in FIG. 2. Incidentally, because the register rollers 34 and the attaching roller 36A are released from the pressing abutment status, they cause substantially no load on the sheet S when the sheet S is drawn out.

If a separator sheet-jam detector 51B detects a sheet jam, the image forming apparatus 1 immediately stops sheet conveyance, thereby preventing the sheet S from being forced into the brush roller 39A provided adjacent to the transfer drum 35. Simultaneously, the transfer drum 35 is shifted away from the photosensitve drum 11 to its withdrawn position. Subsequently, the operation is substantially the same as the operation performed during the recovery from a transfer-portion sheet jam as described above. As discussed above, because the entire length of the jammed sheet S is inside the transfer/conveyance unit 30, the unit 30 can be drawn out without tearing the sheet S.

This embodiment achieves the following advantages.

Because a portion that needs a sheet-jam recovery can be drawn out from the main body of the image forming apparatus 1, the sheet can be easily removed without damage to interior components, thus reducing the amount of labor required for the sheet-jam recovery. Further, because the entire length of the jammed sheet is contained in the draw-out portion (transfer/conveyance unit 30), there is no possibility that when the portion is drawn out, the sheet will be torn, leaving a fragment of the sheet S inside the image forming apparatus, and no possibility that when the sheet S is removed, the film 35S of the transfer drum 35 will be deformed or broken. Further, the danger of damaging the surface of the photosensitive drum 11 is significantly reduced as compared with a conventional image forming apparatus wherein a user must put his/her hand into the apparatus to remove a jammed sheet S. Still further, because the embodiment only needs to stop sheet conveyance when detecting a sheet jam, and does not need any special sheet conveyance sequence, the operational sequence of the apparatus can be simplified.

The operation during sheet-jam detection and recovery has been described on the assumption that only one sheet is fed. Next described will be similar operation performed in the serial feeding mode in which a plurality of sheets are serially fed.

For example, when the image forming apparatus stops sheet conveyance due to a sheet jam at the separator of the first-fed sheet, the leading portion of the second sheet may have reached the conveyor portion 30A of the transfer/conveyance unit 30. In such a case, the second sheet must be removed before the transfer/conveyance unit 30 is drawn out. Otherwise, the second sheet S will be torn or broken when the transfer/conveyance unit 30 is drawn out.

To facilitate removing the second sheet in such a case, a movable cover is preferably provided adjacent to the conveying rollers 25 and the guides 26, for example, in the right-hand side wall (with reference to FIG. 1) of the apparatus. The movable cover may be drivingly connected to one of the rollers 25, 25 and one of the guides 26, 26 in such a manner that when the cover is opened, the roller 25 and the guide 26 connected to the movable cover are separated from the other roller 25 and guide 26. With such a construction, a user can easily remove the second sheet. Then, the user can draw out the transfer/conveyance unit 30 to remove the first sheet without causing any problem.

Thus, this embodiment achieves the above-described advantages both in the serial feeding mode and in the single sheet feeding mode.

[Second Embodiment]

In a second embodiment which will now be described, recovery from sheet jam trouble during serial or continuous feeding of sheets can be conducted more easily than in the first embodiment described hereinbefore. The following description of the second embodiment will be focused only on portions of the second embodiment which differs from the first embodiment.

In general, in an image forming apparatus of the type which performs multiplexed image forming process by using a transfer drum system, the leading end of a sheet S attracted on the transfer drum 35 is located at a predetermined position on the transfer drum 35. Furthermore, in order to reduce the size of the body 1 of the image forming apparatus, the size of the transfer drum 35 is made just large enough for holding a single sheet of the greatest size (maximum-size sheet) among the sheets which can be handled by the apparatus. Therefore, the circumferential length of the transfer drum 35 is greater than the length of the maximum-size sheet S as measured in the direction of conveyance, and the difference between these two lengths provides the minimum inter-sheet gap between successive sheets S continuously fed from the sheet feeding portion. The term "minimum inter-sheet gap" is recited here to mean the distance which is set between successive sheets in the case of monochromatic image forming process, i.e., when the sheet S is held on the transfer drum 35 only during one full rotation of drum 35.

In the image forming apparatus of the present invention, the length of the conveyance path AC between the portion A where the sheet is passed-over from the draw-out portion (transfer/conveyance unit) 30 to the feeder portion (feeder unit) 20 and the portion C where a sheet jam in the separator portion is detected is determined to be smaller than the circumferential length Ld of the transfer drum 35. At the same time, the length BD of conveyance path between the transfer jam detector (position B) and the position D where the sheet is passed-out from the draw-out unit 30 to the fixing portion (fixing unit) 40 is determined to be greater than the above-mentioned minimum inter-sheet gap between successive maximum-size sheets S. According to this arrangement, the sheet S during continuous feed is stopped in a state illustrated in FIG. 5.

More specifically, FIG. 5 illustrates the position reached by the sheet S when the image forming apparatus is stopped due to sheet jam occurring in the separator portion or in the transfer portion. The sheet may be a sheet of paper. For instance, in the event of a sheet jam occurred in the separator portion, the subsequent sheet S coming from the feeder unit 20 has not yet reached the transfer/conveyance unit 30, due to the fact that the circumferential length Ld of the transfer drum is greater than the length of conveyance of path AC. Meanwhile, the preceding sheet S has already passed the transfer/conveyance unit 30 and reached the fixing unit 40. The same applied to the case of sheet jam occurring in the transfer portion. According to this arrangement, only the jamming sheet S is left in the transfer/conveyance unit 30 in the event of any sheet jam.

This arrangement offers the following advantage.

In the first embodiment described before, the recovery from sheet jam is carried out by opening the door of the body 1 of the image forming apparatus, removing the sheet S that is jammed in the feeder unit 20, and then drawing out the transfer/conveyance unit 30. In contrast, in the second embodiment, it is not necessary to follow these steps: namely, the recovery can be conducted freely without the risk of leaving any fragment of sheet S inside the apparatus body 1.

[Third Embodiment]

Figure 6:
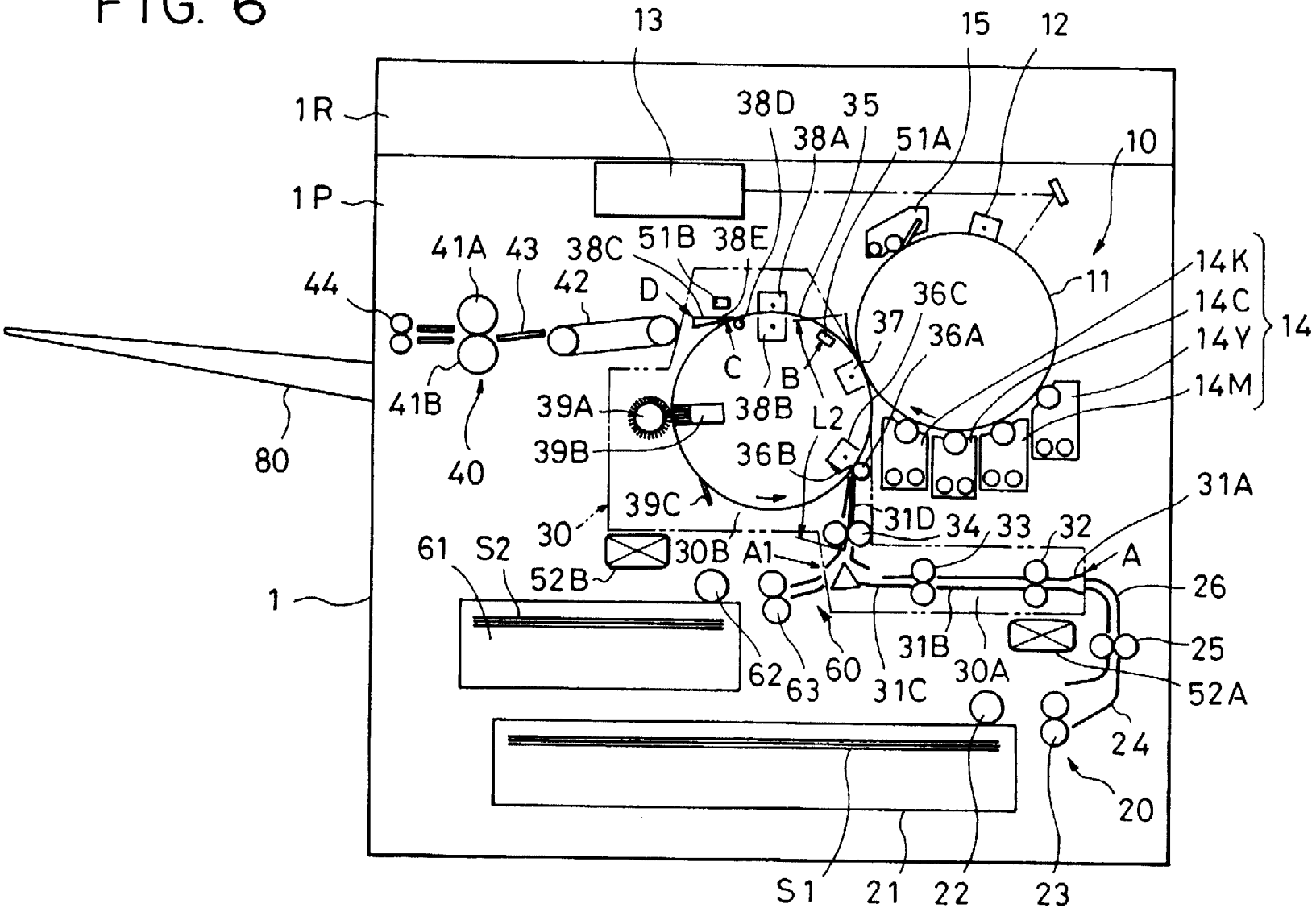
FIG. 6 is a longitudinal sectional view of Embodiment 3 (a laser beam printer) of the image forming apparatus of the invention.

FIG. 6 illustrates the structure of a third embodiment of the image forming apparatus in accordance with the present invention. The third embodiment contains parts or components which are the same as or equivalent to those used in the first embodiment in terms of construction or function. Such parts or components are denoted by the same reference numerals and detailed descriptions thereof are omitted.

The third embodiment of the image forming apparatus employs a plurality of feeding portions in order to enable simultaneous use of a plurality of types of sheets of different sizes.

More specifically, there are two types of sheets S handled by this image forming apparatus: the aforementioned maximum-size sheet S and a half-size sheet which has a length half that of the maximum-size sheet. These sheets are, for example, A-3 size sheets and A-4 size sheets. In order to attain higher image-producing efficiency, when the half-size sheets are used, two half-size sheets are carried on the transfer drum 35 at one time. The construction and operation of the third embodiment will be described with reference to the mode which uses the half-size sheets.

Referring to FIG. 6, the image forming apparatus employs two sheet feeder portions or units: a feeder unit 20 for feeding the maximum-size sheets S1 and a feeder unit 60 for feeding the half-size sheets S2.

The transfer/conveyance unit 30, which is bordered by an imaginary line in FIG. 6, can be drawn forwardly towards the user.

The half-size sheets S2 in a cassette 61 are fed one by one by cooperation between a pick-up roller 62 and separator/feeder rollers 63 which are arranged to form a roller pair. The half-size sheet S2 thus fed is advanced past the sheet pass-over portion A1 between the feeder unit and the transfer/conveyance unit 30 to reach a register roller pair 34. The register rollers 34 operate in synchronization with the image recording start signal so as to convey the half-size sheet to the transfer drum 30A.

The next or second half-size sheet S2 is then fed from the feeder unit 60 with a predetermined interval or distance between it and the first half-size sheet. The register rollers 34 operate with the corresponding time interval after the convey of the first half-size sheet, whereby two half-size sheets S2 are attracted onto the surface of the transfer drum 35.

After a monochromatic or multi-color image is transferred to each of the successive half-size sheets S2, these sheets are separated from the transfer drum 35 and are ejected to the exterior of the apparatus past the fixing unit 40 one after the other. When the image to be formed is monochromatic, the third and subsequent half-sheets are fed with the same interval or spacing as that between the first and the second half-size sheets. When the image is a multi-color image, however, the feed of the third and fourth sheets is delayed by the time which is required for repetition of rotation of the transfer drum 35 during multiplexed image transfer.

As in the case of the first embodiment, the image forming apparatus of the third embodiment employs jam detectors 51A and 51B which are respectively provided in the transfer section and the separator section, for the purpose of detecting any sheet jam occurring in connection with the transfer drum 30B.

Figure 7:
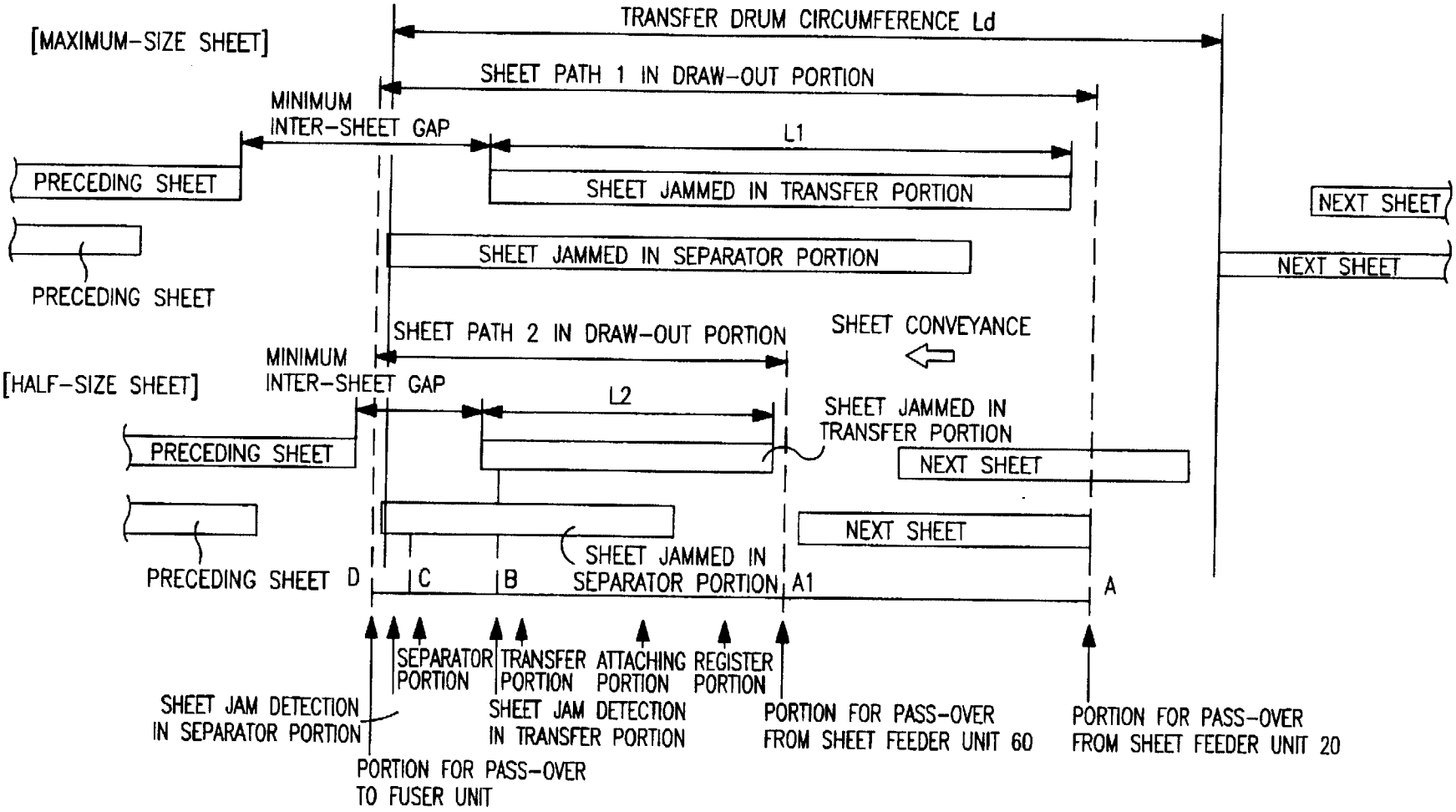
FIG. 7 schematically illustrates the stop positions of a sheet when a sheet jam occurs in Embodiment 3.

In this embodiment, as shown in FIG. 7, the length of the conveyance path A1B between the portion A1 where the sheet is passed-over from the feeder unit 60 to the transfer/conveyance unit 30 and the transfer sheet-jam detecting position B is determined to be greater than the length L2 of the half-size sheet. At the same time, the length of the conveyance path A1C between the above-mentioned pass-over position A1 and the separator sheet jam detecting position C is determined to be smaller than the sum of the length L2 of the half-size sheet and the aforementioned minimum inter-sheet gap. Furthermore, the length of the sheet conveyance path BD between the transfer sheet jam detecting position B and the pass-over portion between the transfer/conveyance section B and the fixing section D is set to be smaller than the minimum sheet gap.

This ensures that one or two (in the multiplex transfer mode) sheets remain in the transfer/conveyance unit 30 without allowing other sheets S to remain or stagnate in the pass-over portions A, A1 between adjacent units, irrespective of whether the sheet jam has occurred in the transfer section or in the separator section. Consequently, the described arrangement permits the transfer/conveyance unit 30 to be drawn out without tearing the sheet S, thus enabling easy recovery from sheet jam. Furthermore, this embodiment eliminates the necessity for replacing sheets in the cassette with sheets of a different size, by virtue of the provision of the plural feeder units 20, 60.

A description will now be given of the case where sheets of an intermediate size, e.g., B-4 size sheets, are used in the image forming apparatus. Such intermediate-size sheets are fed from the feeder unit 20, due to requirement from the function of the image forming apparatus. The image forming operation is conducted such that single sheet is held at a time on the transfer drum 35, as in the image formation on the maximum-size sheet (A-3 size sheet). The recovery from sheet jam therefore is conducted in the same manner as that in the first embodiment. Thus, the present invention offers the same advantages on a variety of sizes of sheets.

In each of the embodiments described hereinbefore, when the image forming apparatus is stopped due to sheet jam occurring on or around the transfer drum 30B, the preceding sheet S which is immediately downstream of the jammed sheet may undesirably be stopped while in the nip between the fixing roller 41A and the pressing roller 41B, with the result that the downstream sheet cannot be recovered due to a nip line formed on this sheet.

In order to overcome this problem, it is desirable that the fixing unit 40 and the transfer/conveyance unit 30 are operable independently of each other. In the event of sheet jam occurring in the transfer/convey section, the fixing unit is controlled to operate so as to safely eject the above-mentioned downstream sheet, even after the transfer/conveyance unit 30 has been stopped in response to the detection of the sheet jam. This arrangement offers an advantage in that the downstream sheet which carries the image formed thereof can be used without being wasted, while eliminating the necessity of pulling out the sheet from the fixing unit 40, thus further facilitating recovery from a sheet jam.

In each of the described embodiments, the transfer/conveyance unit 30 can be drawn out of the body 1 of the image forming apparatus. The arrangement, however, may be such that the fixing unit 40 also can be drawn out as a unit with the transfer/conveyance unit 30, without impairing the advantage of the present invention.

The jam detectors for detecting sheet jam occurring on the transfer drum 30B also may be positioned at any suitable locations, although these detectors are disposed in the transfer section and the separator section in the described embodiments.

As will be understood from the foregoing description, in the third embodiment of the image forming apparatus of the present invention, all sheets jamming on the transfer drum are stationed at positions where they do not bridge the transfer/conveyance section and the feeder section when the image forming apparatus is stopped in response to detection of the sheet jam. It is therefore possible to draw the transfer/conveyance unit 30 out of the body of the image forming apparatus without tearing the jammed sheet and, hence, to safely remove all of the jammed sheets external to the body of the image forming apparatus without fail.

The first and second embodiments described before involve a risk that the sheet may fail to reach the jam detector 51A in a predetermined timing due to a delay in conveyance caused by a slip occurring between the sheet and the conveying means, e.g., the pick-up roller 22, the sheet separator roller pair 23, conveyor roller pair 25 or the like. A risk also is involved that a sheet jam occurs midway along the conveyance path. In such cases, the jam detector 51A detects such a delay of sheet conveyance as occurrence of the clinging jam of the sheet about the photosensitive drum 11. When the image forming apparatus is stopped upon detection of this jam, the sheet is undesirably stopped at such a position that part of the sheet resides in the feeder unit 20 while the remainder is received on the transfer/conveyance unit 30, due to delay of convey of the sheet. In order to avoid such inconvenience, the image forming apparatus of the invention may further incorporate a sheet sensor 51C disposed in the vicinity of the inlet of the conveyance path formed by the transfer/conveyance unit 30. In operation, when the sensor 51C is sensing the presence of the sheet while occurrence of jam is detected by the detector 51A, the conveyor roller pair 32, 33 operate without stopping until the sensing of the sheet by the sensor 51C is terminated, after the stopping of the transfer drum 35. In an alternative arrangement, the sensor 51C is omitted, and a control is conducted in such a manner as to cause the conveyor roller pair 32, 33 to operate for a predetermined period of time while the transfer drum 35 is stationary, after detection of occurrence of sheet jam by the detector 51A.

[Fourth Embodiment]

Figure 8:
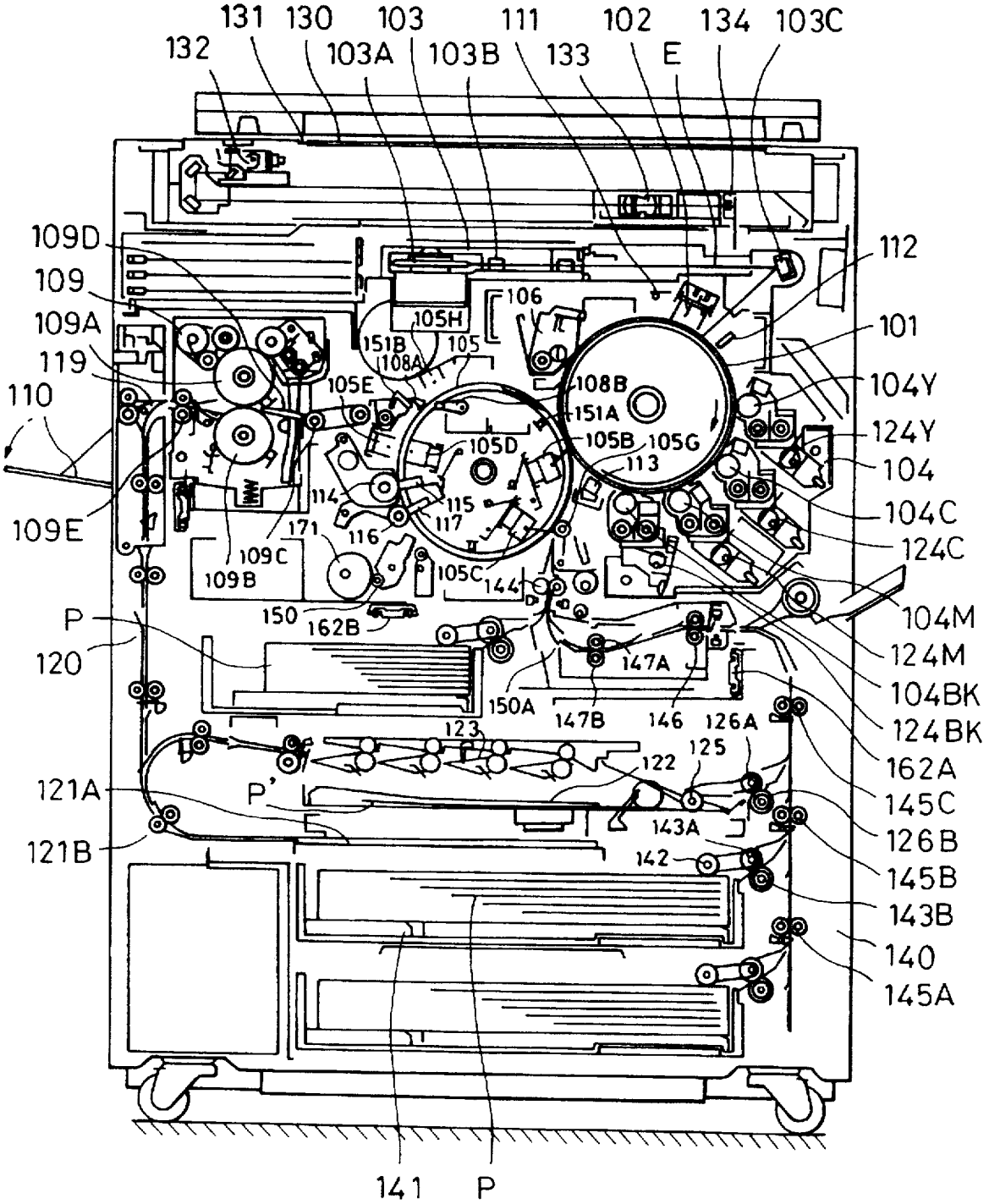
FIG. 8 is a sectional view of Embodiment 4 (a copying machine) of the image forming apparatus of the invention.
Figure 9:
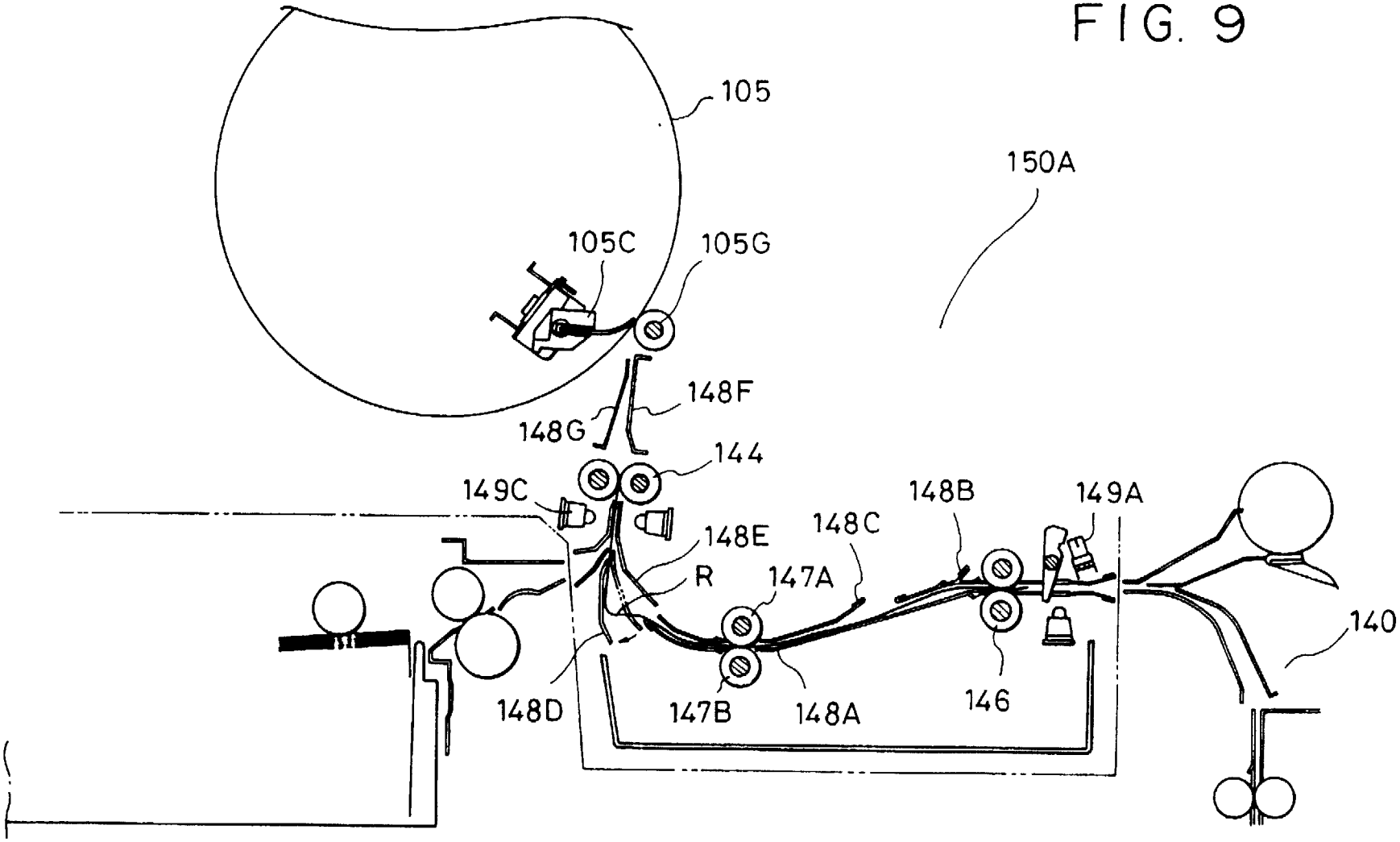
FIG. 9 illustrates a convey portion employed in the copying machine shown in FIG. 8.
Figure 10:
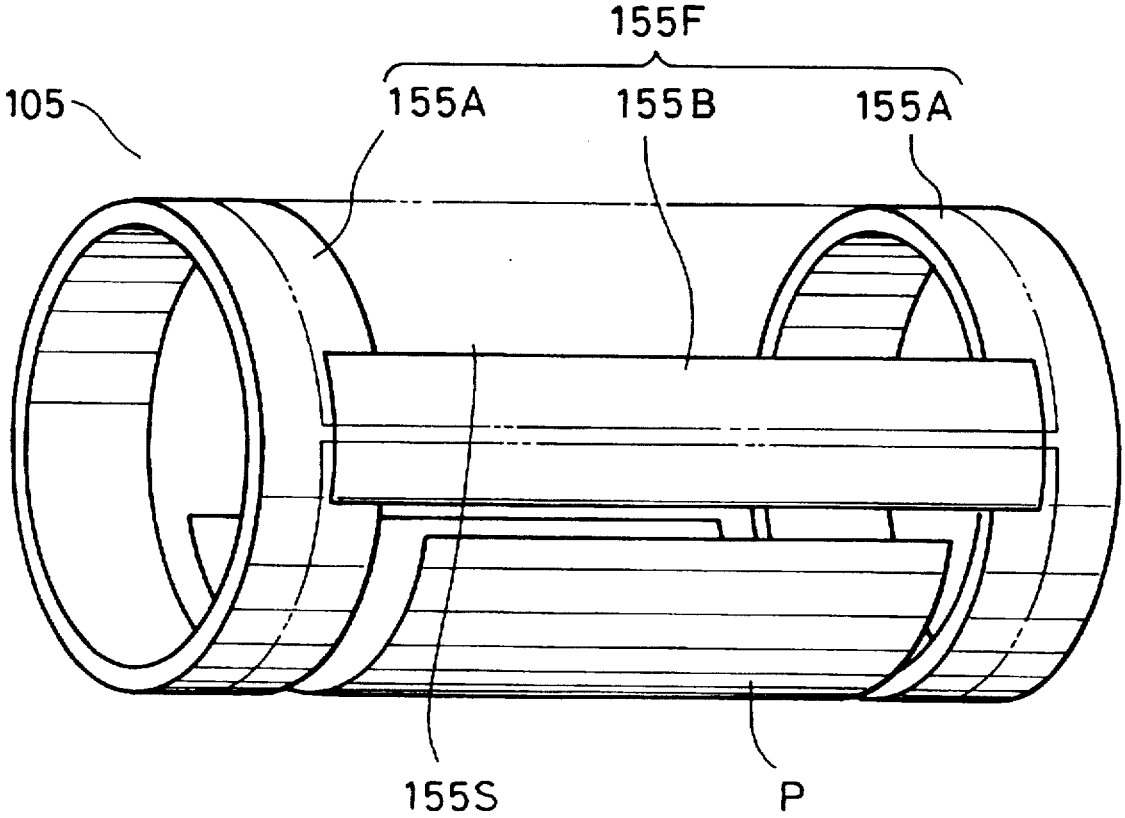
FIG. 10 is a perspective view of a transfer drum employed in the copying machine shown in FIG. 8.
Figure 11:
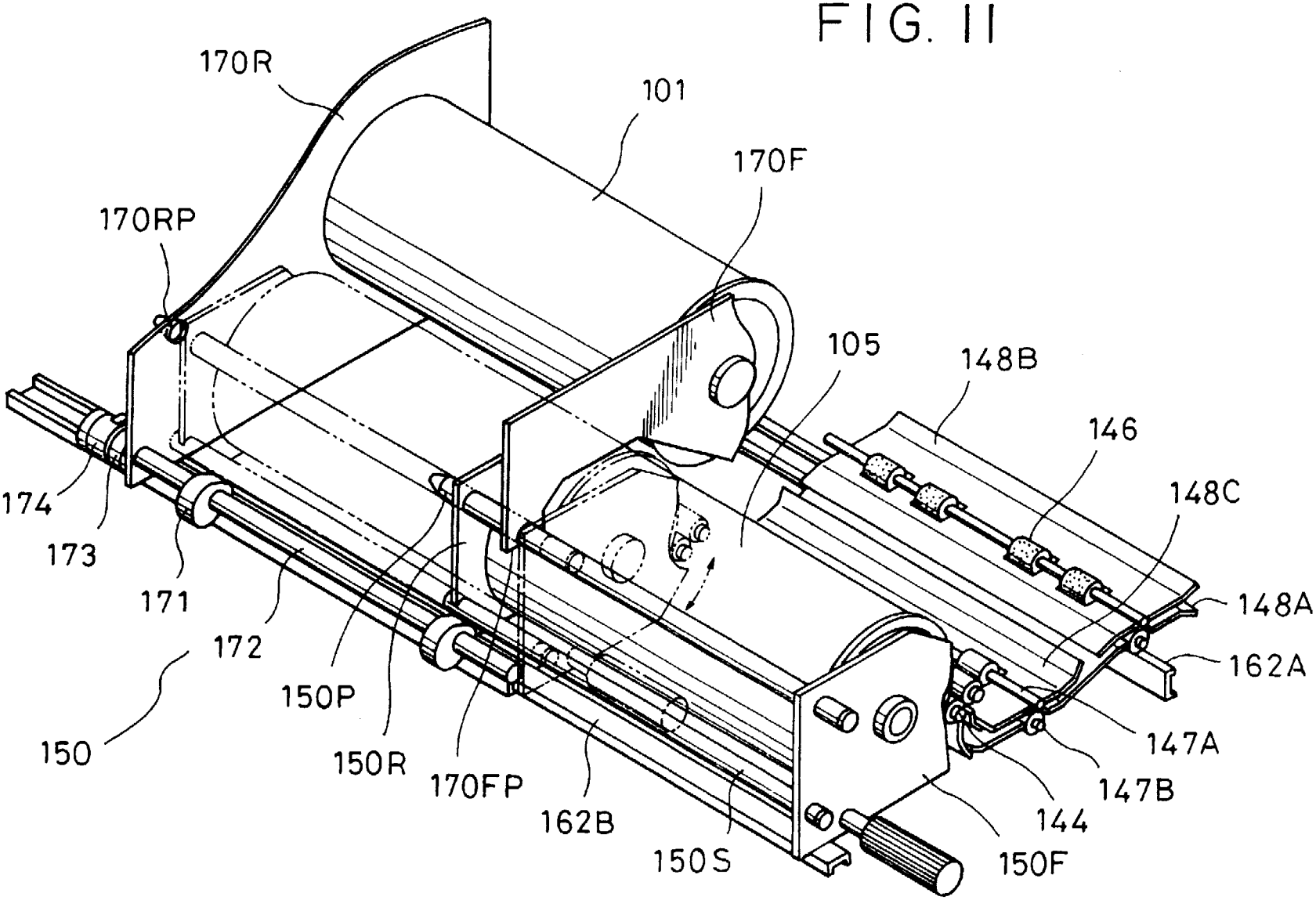
FIG. 11 is a perspective view of a transfer/conveyance unit employed in the copying machine shown in FIG. 8.

An image forming apparatus in accordance with a fourth embodiment of the present invention is described below with reference to the drawings. This embodiment uses a copying machine as an image forming apparatus. FIG. 8 is a schematic sectional view illustrating the configuration of a copying machine, FIG. 9 is a drawing illustrating a conveyance portion of the copying machine, FIG. 10 is a drawing illustrating a transfer drum, FIG. 11 is a drawing illustrating the configuration of a transfer/conveyance unit, FIGS. 12(*a*) and 12(*b*) are drawings illustrating the separating operation on the transfer drum, FIGS. 13(*a*) and 13(*b*) are drawings illustrating the operation of the sheet feeder portion and the conveyance portion at the time of occurrence of jam in separation, and FIGS. 14(*a*) and 14(*b*) are drawings illustrating the operation of the fixing unit at the time of occurrence of jam in the transfer portion.

The schematic configuration of the copying machine in this embodiment is described below with reference to FIGS. 8 through 11. This embodiment relates to a color copying machine which employs an electrophotographic method as an image forming method, and for which the present invention is considered particularly effective. This copying machine has as an upper portion a digital color image reader portion and as a lower portion a digital color image printer portion.

{Reader Portion}

The configuration of the reader portion is briefly described below. In FIG. 8, when the user places an original 130 on an original base glass 131 and starts the read operation, exposure scanning is performed by an exposure lamp 132. The light reflected from the original 130 is passed through a lens 133 to form an image on a full color sensor 134 from which a color separated image signal is obtained. This signal is input, through an amplification circuit, to a video processing unit in which the signal is subjected to various types of processing, and is then transmitted to the the printer portion below.

{Printer Portion}

The configuration of each of the parts in the printer portion is described below.

(Image Forming Means)

In FIG. 8, reference numeral 101 denotes a photosensitive drum as an image holding member which is axially supported and which is rotated in the arrow direction shown in the drawing. A pre-exposure lamp 111, a primary charger 102, an exposure optical system 103 comprising a laser oscillator or the like, a potential sensor 112, a development unit 104, on-drum light detection means 113, a transfer drum 105 and a cleaning device 106 are arranged in order around the photosensitive drum 101 along the rotation direction thereof.

The pre-exposure lamp 111 and the primary charger 102 uniformly supply charge to the surface of the photosensitive drum 101. The photosensitive drum 101 is then exposed to light E, for example, a laser beam, which is modulated according to the record image signal by the exposure optical system 103 through a polygon mirror 103A, a lens 103B and so on to form an electrostatic latent image. The electrostatic latent image is then developed by the development unit 104. In this embodiment, four development units 104Y, 104C, 104M and 104BK which contain developers (referred to as "toner" hereinafter) of yellow, cyan, magenta and black, respectively, are movably arranged in parallel so as to selectively approach the photosensitive drum 101 by the operations of eccentric cams 124Y, 124C, 124M and 124BK.

The cleaning unit 106 is provided on the downstream side of the image transfer region in the rotation direction of the photosensitive drum 101 so as to clean the surface of the photosensitive drum 101 by scraping off the toner remaining untransferred to a recording material from the photosensitive drum 101. The above process is repeated to form an image.

(Sheet Feeder Means)

A sheet feeder unit 140 comprises a cassette 141 containing recording sheets P as recording materials, a pickup roller 142 for feeding the recording sheets P, one by one, from the cassette 141, sheet feeding rollers 143A and 143B and conveyance rollers 145A, 145B and 145C for conveying the recording sheets P sent from the pickup roller 142 to the transfer/conveyance unit 150, and a sheet guide and so on.

(Conveyance Means and Register Means)

In FIG. 9, the recording sheet P supplied from the sheet feeder unit 140 is conveyed by conveyance rollers 146, 147A and 147B while being guided by conveyance guides 148A, 148B, 148C, 148D and 148E, which constitute the conveyance portion 150A. Reference numeral 144 denotes a pair of register rollers which serve as register means for sending the recording sheet P to the transfer drum 105 described below at the correct timing for image formation. Reference numerals 148F and 148G each denote an attaching guide for guiding the recording sheet P sent from the register rollers 144 to the transfer drum 105. In FIG. 9, a portion which can be drawn out from the apparatus body is shown by a two-dot chain line.

The conveyance guide 148D is supported so as to be movable in the arrow direction shown in FIG. 9 for securing a space for the loop of the recording sheet P which is formed when the leading end of the recording sheet P is stopped by the register rollers 144. The register rollers 144 can also automatically release the state of pressure contact therebetween by a mechanism (not shown). This facilitates removal of the recording sheet P jammed between the rollers. Reference numerals 149A and 149C each denote a recording sheet sensor for detecting the leading end of the recording sheet P conveyed. The sensors 149A and 149C are respectively mounted at the entrance to the conveyance portion 150A and at a position just ahead of the register rollers 144. Each of the recording sheet sensors 149A and 149C comprises a photosensor or the like.

(Recording Material Holding/Conveyance Means)

In FIGS. 9 and 10, reference numeral 105 denotes a transfer drum for holding and conveying the recording sheet P conveyed from the register rollers 144. As shown in FIG. 10, the transfer drum 105 comprises a frame 155F formed by connecting ring members 155A at both ends by a connecting member 155B, and a recording sheet holding sheet film 155S (for example, RET (Polyethylene Terephthalate), PVdF (Polyvinylidene Fluoride) or the like) which is cylindrically wound on the frame 155F.

An attaching roller 105G is separably supported by the transfer drum 105 at a position where the recording sheet P conveyed from the register rollers 144 contacts the transfer drum 105. A backup member for opposing the pressure of the roller 105G and an attaching charger 105C are disposed in the transfer drum 105 with the recording sheet holding sheet film 155S between the attaching roller 105G and the backup member and the attaching charger 105C. Referring to FIG. 8, a transfer charger 105B is disposed in the transfer drum 105 in the image transfer region where the photosensitive drum 101 and the transfer drum 105 are opposed to each other.

As shown in FIG. 8, separation members for separating the recording sheet P, specifically, a destaticizing charger 105H, a separation claw 108A and a film push-up roller 108, are disposed on the downstream side of the transfer charger 105B in the rotation direction of the transfer drum 105. Film destaticizing chargers 105D and 105E are also disposed with the recording sheet holding sheet film 155S therebetween. A brush roller 114, a corona discharger or a brush destaticizer 115, an oil removing roller 116 and a backup brush 117 are provided on the further downstream side of transfer charger 105B so as to clean off the toner and sheet powder which adhere to the recording sheet holding surface of the recording sheet holding sheet film 115S. The oil removing roller 116 removes the oil which is used in the fixing unit below and which penetrates into the recording sheet P and adheres to the surface of the recording sheet holding sheet film 155S during double recording.

The transfer drum 105 is disposed so as to be separable from the photosensitive drum 101 and is thus separated therefrom at a time other than the time of normal recording operation. This prevents the transfer drum 105 from contacting the photosensitive drum 101 for a long time, and the surface of the photosensitive drum 101 from being damaged by contact with the recording sheet when jam is handled.

The transfer/conveyance unit 150 having the conveyance means 150A and the transfer drum 105 can be drawn out from the apparatus body toward the operator by using sliders 162A and 162B. This causes safe, reliable and easy handling of jam or maintenance.

FIG. 11 shows details of the configuration of the transfer/conveyance unit 150. The transfer/conveyance unit 150 comprises a unit frame assembled by a unit front plate 150F, a unit rear plate 150R, a positioning shaft 150P and a stay shaft 150S. The transfer drum 105 is rotatably supported by the unit frame. The positioning shaft 150P passes through a groove 170FP of a front plate 170F of the apparatus and a hole 170RP of a rear plate 170R thereof so that the unit 150 is positioned and supported by the apparatus body. A cam shaft 172 to which cams 171 are fixed is also rotatably supported by the apparatus body, the surface of each of the cams 171 being close to or contacting the stay shaft 150S (the stay shaft 150S being urged on the side of the cam 171 by a mechanism (not shown)). A gear 173 and a spring clutch 174 are fixed to an end of the cam shaft 172 so as to transmit a driving force from the apparatus body, and the cams 171 can thus be selectively rotated and stopped, 180° at a time, by cooperation of the gear 173 and the clutch 174 (and a plunger (not shown)). The stay shaft 150S is pushed by rotation of the cams 171 so that the transfer/conveyance unit 150 is rotated around the positioning shaft 150P as the center. The transfer drum 105 is thus placed at two positions including a position (referred to as "operation position" hereinafter) closest to the photosensitive drum 101 and a position (referred to as "retract position" hereinafter) most separated therefrom in accordance with the stop phase of the cams 171.

The unit 150 is described in further detail below. The transfer drum 105 is positioned at the retract position by a stopper (not shown), the stay shaft 150S being slightly separated from the cam surfaces. At this position, the transfer drum 105 can be drawn out from the apparatus body. Conversely, a safety mechanism (not shown) is provided for preventing the transfer/conveyance unit 150 fro being drawn out of the apparatus body whenever the transfer drum 105 is not at the retract position. This prevents the photosensitive drum 101 and the transfer drum 105 being damaged by contact therebetween when the transfer/conveyance unit 150 is drawn out from the apparatus body.

{Fixing Unit)

In FIG. 8, a fixing unit 109 comprises a fixing roller 109A having a heat source such as a halogen heater, which is provided therein, a pressure roller 109B (sometimes having a heat source) pressed against the fixing roller 109A, a conveyor belt 109C for guiding the recording sheet P to a nip portion of rollers 109A, 109B, an entrance guide 109D and a pair of sheet delivery rollers 109E for conveying, to the outside of the apparatus, the recording sheet discharged from the rollers 109A, 109B. The recording sheet P to which an image is transferred is heated and pressed while being passed between the fixing roller 109A and the pressure roller 109B to fix the transferred image, and is then conveyed, by the delivery rollers 109E, to the delivery tray 110 provided outside the apparatus.

(Double-Side Recording Mechanism)

The copying machine of this embodiment is configured so that recording can be made on both sides of the recording sheet P. The mechanism for double-side recording is described below. In FIG. 8, a conveyance path switching guide 119 is rotatably provided on the downstream side of the fixing unit 109 so that in one position it creates a sheet path for delivering the sheet to the outside of the apparatus and in another position it creates a sheet path for double-recording and the correct sheet path can automatically be selected after image fixing. The double recording sheet path has a longitudinal conveyance path 120, a reversal path 121A, reversal rollers 121B and an intermediate tray 122. The recording sheet P guided to the reversal path 121A is reversed by the reversal rollers 121B, conveyed with the trailing end thereof at the head, and is then loaded on the intermediate tray 122. The recording sheets P loaded on the intermediate tray 122 are fed, one by one, by the pickup roller 125. The double-recording sheet path is then joined to the sheet path of the sheet feeder unit 140 to guide the recording sheet to the conveyance portion 150A. In this way, images are formed on both sides of the recording sheet by the image forming means.

A plurality of guide portions 123 provided above the intermediate tray 122 are selectively vertically moved so as to load sheets of any size with the leading ends lined up on the intermediate tray 122 in accordance with the size of the recording sheets contained therein.

(Control Unit)

The control unit for controlling the operation of each of the above units is described below. Although the control unit is not shown in the drawing, the control unit comprises a control substrate for controlling the operation of the mechanism of each unit, a motor drive substrate and so on.

A drive system of the copying machine of this embodiment is described below. The photosensitive drum 101 and the transfer drum 105 are driven by a single motor. The motor drives the photosensitive drum 101, and the drive is transmitted from the photosensitive drum 101 to the transfer drum 105 through gears in order to prevent a relative speed difference between both drums. The recording sheet conveyance roller provided on the upstream side of the register rollers 144 in the conveyance direction of the recording sheet is rotated by another motor. Since the drive is transmitted to each of the rollers through a clutch, rotation timing of each roller can be independently controlled. However, the driving system is not limited to this, and it is only necessary that the rotation of at least the register rollers 144 and the other rollers be independently controlled.

The fixing unit 109 is also provided with its own motor for driving the conveyance belt 109C, a pair of the fixing rollers 109A and 109B, and a pair of the delivery rollers 109E.

(Image Forming Operation)

The image forming operation of the printer portion configured as described above is described below. In this embodiment, it is assumed that a sheet is supplied from a second sheet feeding cassette 141. When an image forming operation start signal is generated, the cams 171 shown in FIG. 11 make a half turn, and the transfer drum 105 rotates to the operation position with the half turn of the cams 171, and then transfer drum 105 is rotated synchronously with the photosensitive drum 101. At this time, the recording sheet P is sent, one by one, from the cassette 141 by the pickup roller 142 shown in FIG. 8. The recording sheet P is guided between the sheet feed guides by the sheet feed rollers 143A and 143B and the conveyance rollers 145B and 145C, and conveyed to the conveyance portion 150A.

In the conveyance portion 150A, the recording sheet P is conveyed to the register rollers 144 by the operation of the conveyance rollers 146A, 147A, 147B and the conveyance guides 148A, 148B, 148C, 148D and 148E, as shown in FIG. 9. At this time, a pair of the register rollers 144 are stopped, and the oblique leading end of the recording sheet P is corrected by entering the nip portion of register rollers 144. After the elapse of a predetermined time (actually, a predetermined time after the leading end of the recording sheet is detected by the recording sheet sensor 149C), the drive of the conveyance rollers 146A, 147A and 147B is stopped. Although the recording sheet P which is conveyed for the predetermined time forms a loop in the state where the leading end thereof butts against a pair of the register rollers 144, a necessary space is formed by movement of the conveyance guide 148D. The space is automatically is extended by the stiffness of the recording sheet P (refer to FIG. 9). The register rollers 144 and the conveyance rollers 146A, 147A and 147B is then rotated for a predetermined time based on the start timing of image formation by the image forming means. The start timing of rotation is set so that the recording sheet coincides with the toner image on the photosensitive drum 101 in the image transfer region.

When the recording sheet P contacts the transfer drum 105, the recording sheet P is electrostatically attached to the recording sheet holding sheet film 155S by corona discharge from the attaching charger 105C and the operation of the attaching roller 105G. The attaching roller 105G is usually separated from the transfer drum 105 due to a decrease in load, and is brought into pressure contact with the transfer drum 105 when the recording sheet P strikes on the drum 105. As the transfer drum 105 is rotated synchronously with the photosensitive drum 101, the recording sheet P is conveyed to the image transfer region while being held on the transfer drum 105. The toner image formed on the photosensitive drum 101 by the above-described process is transferred to the surface of the recording sheet P by the transfer charger 105B, and recording sheet P is then conveyed to the separation portion. Since an image of one color is transferred by one transfer operation, when a monochromatic image is formed, the recording sheet P is separated from the transfer drum 105 by the operation below. However, when a multicolor image is formed, the recording sheet P is conveyed again to the transfer region by one rotation while being held on the transfer drum 105 without separation operation. A new toner image is further transferred on the previous image. This process is repeated a necessary number of times. The brush roller 114 is separably supported by the surface of the transfer drum 105, and is separated from the transfer drum 105 at least in the process of multiple transfer.

Figure 12A:
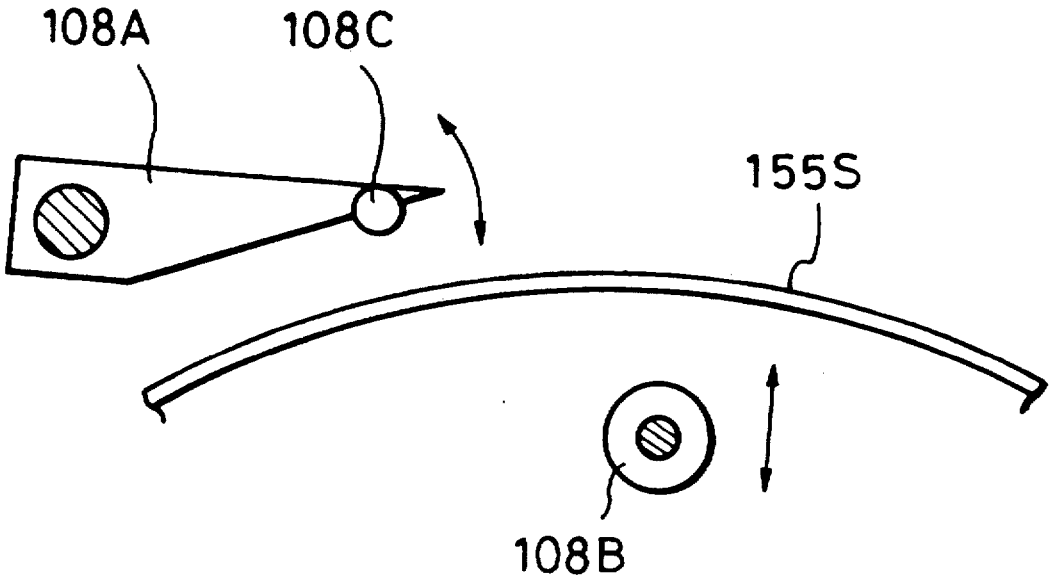
FIGS. 12(*a*) and 12(*b*) illustrate the separation of a sheet from the transfer drum.
Figure 12B:
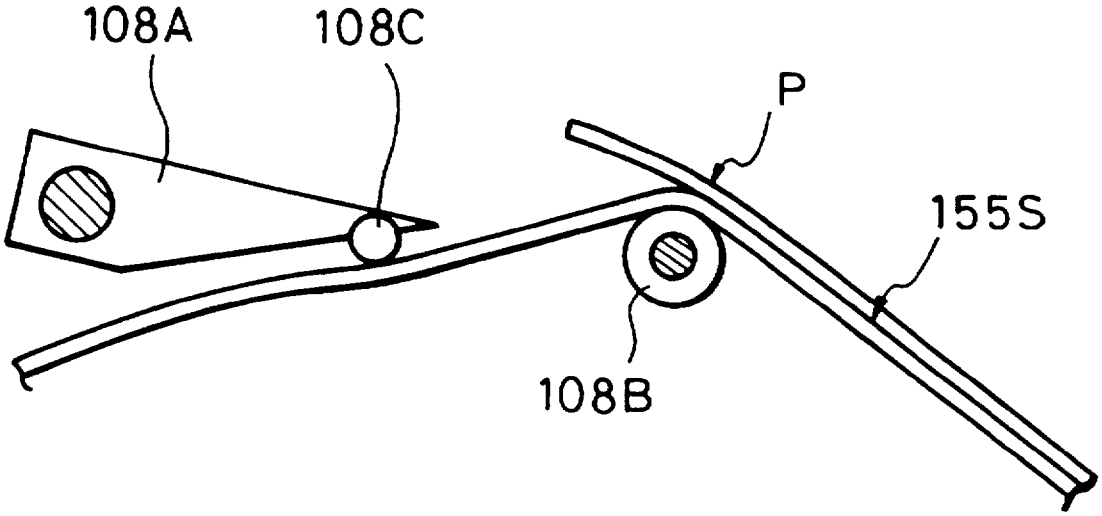

When the image transfer process is completed, the attaching force between the recording sheet P and the recording sheet holding sheet film 155S is reduced by the operation of the destaticizing charger 105H in the separation portion. The recording sheet P is then separated from the transfer drum 105 by the subsequent operation of the separation claw 108A. Specifically, as shown in FIGS. 12(*a*) and 12(*b*), when the leading end of the recording sheet P approaches the separation portion, the film push-up roller 108B pushes the recording sheet holding sheet film 155S outwardly, and the separation claw 108A and an external deformation roller 108C pushes the film 155S inward and deforms it. Since the curvature of the recording sheet holding sheet film 155S is locally increased, the recording sheet P is separated from the film 155S at the deformation position.

The recording sheet separated from the transfer drum 105 is conveyed by the conveyance belt 109C, and is guided to the nip portion between the fixing roller 109A and the pressure roller 109B through the entrance guide 109D. A toner image is fixed to the surface of the recording sheet P by heat of the fixing roller 109A. The recording sheet P is then conveyed by a pair of the delivery rollers 109E, and delivered to the delivery tray 110 provided outside the apparatus. In the final stage, the transfer drum 105 is retracted to the retraction position separated from the photosensitive drum 101 by rotation of cams 171, and the drive of the apparatus is stopped.

In the case of double-side recording, the conveyance switching guide 119 is moved to a predetermined position, and the recording sheet P on one side of which an image was recorded and fixed is guided to the longitudinal conveyance path 120, and is reversed by the reversal roller 121B through the reversal path 121A. The recording sheet P is then conveyed and loaded on the intermediate tray 122 through the guide portions 123. After a necessary number of sheets are loaded, the recording sheets P are sent, one by one, out from the intermediate tray 122 by the pickup roller 125. The recording sheet P then enters the conveyance path of the sheet feeder unit 140 by the sheet feed rollers 126A and 126B, and is conveyed to the conveyance portion 150A. An image is recorded on the other side of the recording sheet P by the same process as that described above. After double-side recording, the recording sheet P is delivered to the outside of the apparatus without the operation of the conveyance switching guide 119.

(Jam Handling Operation)

It is thought that the fault below occurs in conveyance of the recording sheet P in the printer portion. When the recording sheet P sent from a pair of the register rollers 144 is attached to the transfer drum 105 by the attaching roller 105G and the attaching charger 105C, the leading end of the recording sheet P is sometimes not attached and lifts off the recording sheet holding sheet film 155S. In this state, if the recording sheet P passes through the transfer region, the leading end of the recording sheet P will be attracted to the photosensitive drum 101. The attraction is static electricity of the surface of the photosensitive drum 101. At this time, the recording sheet P which was attached to the transfer drum 105 is gradually separated with rotation of the transfer drum 105 after it passes through the transfer region, and is wound around photosensitive drum 101. If the image forming operation is continued, the recording sheet P is forced into the cleaning unit 106, and damages both the photosensitive drum 101 and the cleaning unit 106. It is also very difficult to remove the recording sheet P after it has jammed in this manner.

In order to prevent the above problems, in this embodiment, a transfer portion jam detector 151A is disposed inside the transfer drum 105 immediately below the transfer region, as shown in FIG. 8. This transfer portion jam detector 151A passes light through the recording sheet holding sheet film 155S to optically detect that the recording sheet P is held on the surface thereof. When the recording sheet P is not detected within a predetermined timing, it is determined that the recording sheet P is jammed due to winding on the photosensitive drum 101.

The predetermined timing is set so that a sufficient time is taken from the start of driving of the pickup roller 142 until arrival of the sheet leading end at the transfer portion jam detector 151A. Alternatively, a sheet sensor may be provided on the upstream side of the transfer portion jam detector 151A so that a predetermined sufficient time is taken from passage of the sheet leading end through the sheet sensor to arrival of the leading end at the transfer portion jam detector 151A.

The separation portion where the recording sheet P is separated from the transfer drum 105 is also considered as a portion having the danger of producing a paper jam, as in the image transfer region. In this embodiment, a separation jam detector 151B is provided immediately behind the separation claw 108A, and in addition to the above detector 151A. The separation jam detector 151B mechanically detects the recording sheet P held on the surface of the recording sheet holding sheet film 155S. If the recording sheet P is not detected after a predetermined time, it is decided that a jam has occurred in the separation portion.

The predetermined timing is the same as that in the detection of the above-described jamming caused by winding on the photosensitive drum 101.

Figure 13A:
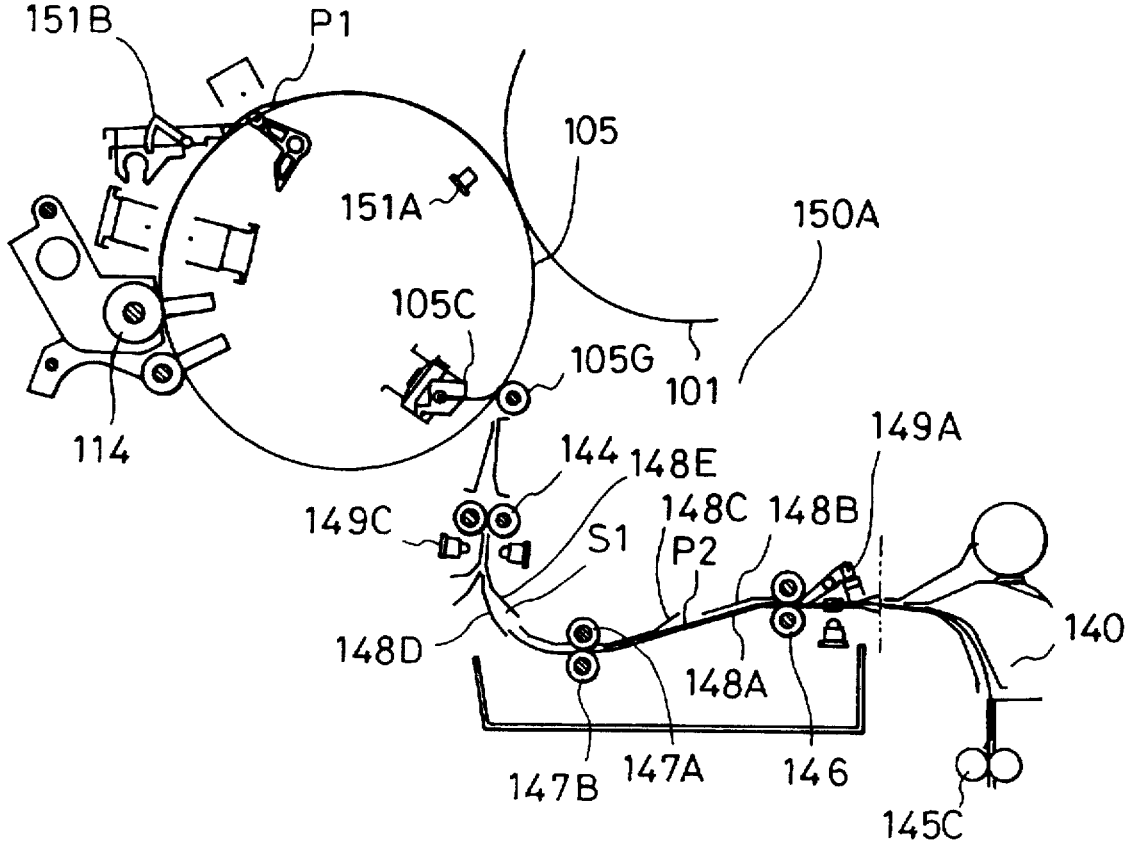
FIGS. 13(*a*) and 13(*b*) illustrate the operations of a sheet feeder unit and a conveyor portion when a sheet jam occurs in a separator portion.
Figure 13B:
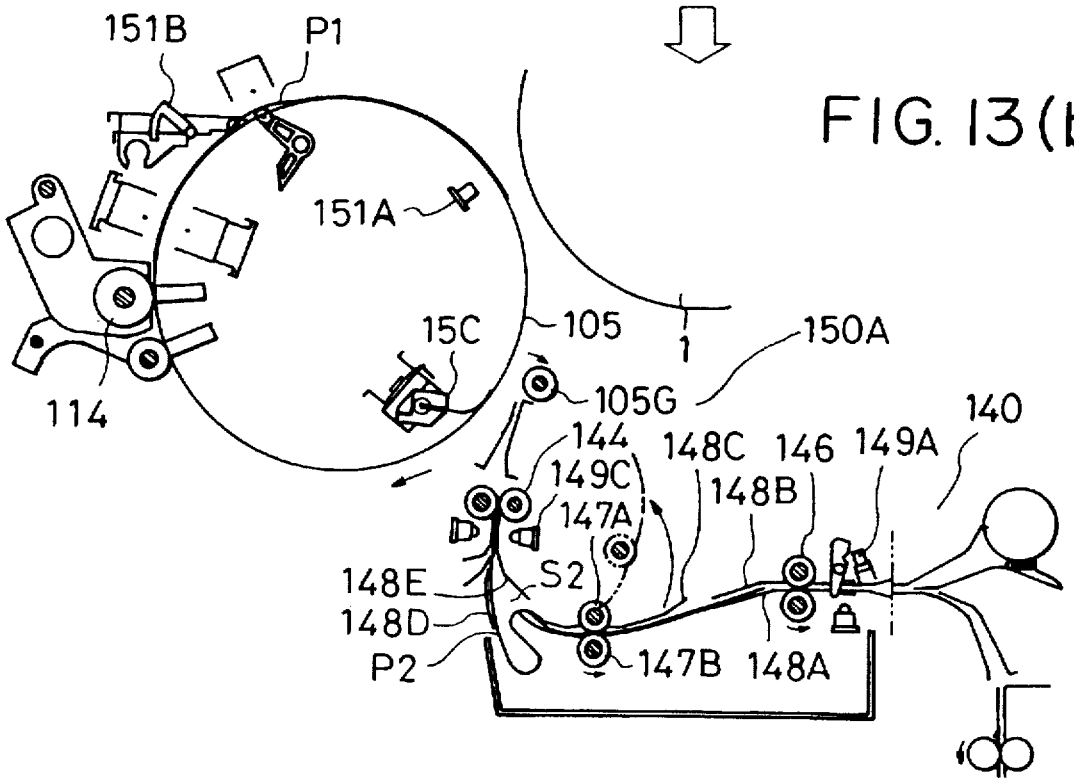

A description will be made with reference to FIGS. 13(*a*) and 13(*b*) of the recording sheet conveyance and jam handling operations when a fault actually occurs in conveyance of the recording sheet P. If jam is detected by the transfer portion jam detector 151A or the separation jam detector 151B, as described above, the photosensitive drum 101 and the transfer drum 105 are immediately stopped to prevent the leading end of the recording sheet P from being forced into the cleaning unit 106 and the brush roller 114. At the same time, the transfer drum 105 is moved to the retraction position.

If all operations are stopped, when recording sheets P are continuously supplied, recording sheet P2 being supplied next to recording sheet P1 is thought to be stopped in the state wherein the sheet P2 is placed over the sheet feeder unit 140 and the transfer/conveyance unit 150. In this case, the transfer/conveyance unit 150 cannot be drawn out from the apparatus body, thereby causing difficulties in handling jam.

In this embodiment, the conveyance rollers 145C, 146A, 147A and 147B provided on the upstream side of the register rollers 144 in the conveyance direction of the recording sheet are stopped for a predetermined time after the transfer drum 105 and the register rollers 144 are stopped. This causes conveyance of the recording sheet P2 which is placed over the sheet feeder unit 140 and the transfer/conveyance unit 150. As a result, the leading end of the recording sheet P2 strikes register rollers 144, and the recording sheet P2 starts to slack between the register rollers 144 and the conveyance rollers 147A and 147B. The conveyance guide 148D moves a significant amount due to the stiffness of the sheet to form a space S2 (second space) greater than a usual space S1 (first space) between the register rollers 144 and the conveyance rollers 147A and 147B. Each of the conveyance rollers 145C, 146A, 147A and 147B is stopped after it is rotated until at least the trailing end of recording sheet P passes through the sheet feeder unit 140 and recording sheet P is conveyed to the conveyance portion 150A. At this time, the recording sheet P2 is stopped in the state where it is greatly curved in the space S2. The pressure contact between the register rollers 144 is then released, and the attaching roller 105G is retracted from the transfer roller 105 (this operation is dispensable in this embodiment). A message of faulty conveyance of the recording sheet is displayed on a display portion of the apparatus in order to urge the user to handle the jam When the user recognizes the message on the display portion, the front door of the apparatus body is opened to draw out the transfer/conveyance unit 150 toward the user. Although, at this time, the leading end of the recording sheet P has moved slightly to the downstream side in the conveyance direction after a jam is detected (the recording sheet P1 is moved to some extent until conveyance is completely stopped after a jam is detected), the leading end does not reach at least the brush roller 114. On the other hand, the trailing end of the recording sheet P2 is stopped in the conveyance portion 150A, as described above. When the transfer/conveyance unit 150 is drawn out from the apparatus, the recording sheet P2 stopped in the unit 150 is pulled out without any portion remaining in the apparatus body. The user separates the jammed sheet P1 from the transfer drum 105 and pulls the sheet P1 upward. At this time, since the pressure contact between the register rollers 144 and the attaching roller 105G is released, the recording sheet P1 can pulled upward without producing a load even if the trailing end of the recording sheet P1 is present in these rollers. Since the conveyance roller 147A and the conveyance guide 148C is upwardly moved to be open, as shown in FIG. 11, the recording sheet P2 conveyed after jammed sheet P1 can easily be removed, as shown in FIG. 13.

A description will now be made of the sequence for driving the conveyance rollers 145C, 146, 147A and 147B after the transfer drum 105 and the register rollers 144 are stopped. When a jam caused by winding on the photosensitive drum 101 is detected by the transfer portion jam detector 151A, or when a jam caused in the separation portion is detected by the separation jam detector 151B, the transfer drum 105 and the register rollers 144 are first stopped, and then the recording sheet sensor 149A near the entrance of the conveyance portion 150A is then checked. When the recording sheet sensor 149A is not interrupted (ON state), i.e., when the recording sheet is absent, the drive of the conveyance rollers 145C, 146, 147A and 147B is immediately stopped. When the recording sheet sensor 149A is interrupted, i.e, it is detected that the recording sheet is present (OFF state), the drive of the conveyance rollers 145C, 146, 147A and 147B is continued without stopping. The recording sheet sensor 149A is then continuously checked. At the moment of passage of the trailing end of the recording sheet P2 (the sensor 149A is switched from the OFF state to the ON state), the drive of the conveyance rollers 145C, 146, 147A and 147B is stopped. This operation can avoid the situation that the recording sheet P is placed over the sheet feeder unit 140 and the transfer/conveyance unit 150.

The sequence is not limited to the above method. For example, the position of a recording sheet may be calculated by measuring the time taken from a reference signal such as the start signal for apparatus operation using a timer. When the calculation result shows that the recording sheet is present at an intermediate position in the course of conveyance between the sheet feeder unit 140 and the transfer/conveyance unit 150, the recording sheet P may be conveyed toward the conveyance portion 150A by rotating the conveyance rollers 145C, 146, 147A and 147B by necessary amounts. In any case, an optimum sequence for an apparatus to which the present invention is applied may be used.

Figure 14A:
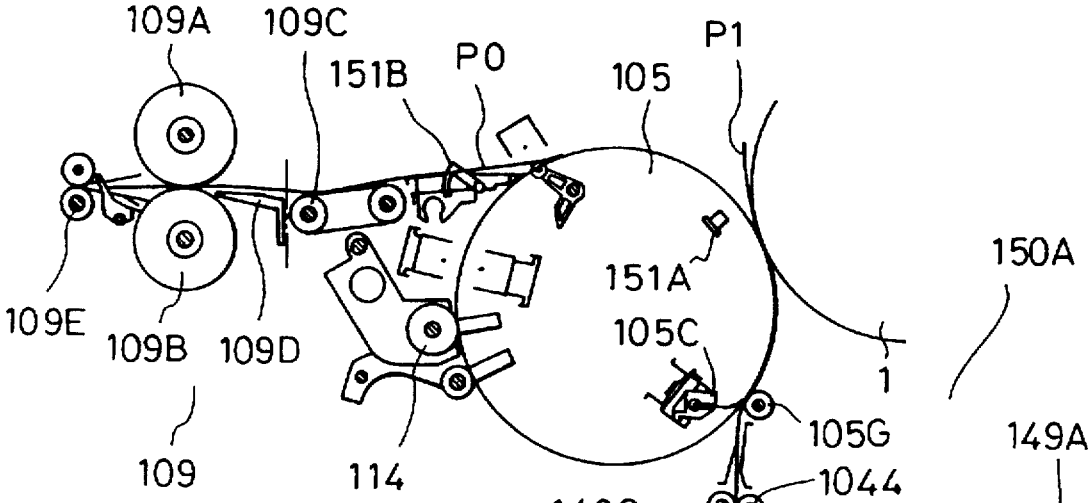
FIGS. 14(*a*) and 14(*b*) illustrate the operation of a fuser unit when a sheet jam occurs in the transfer portion.
Figure 14B:
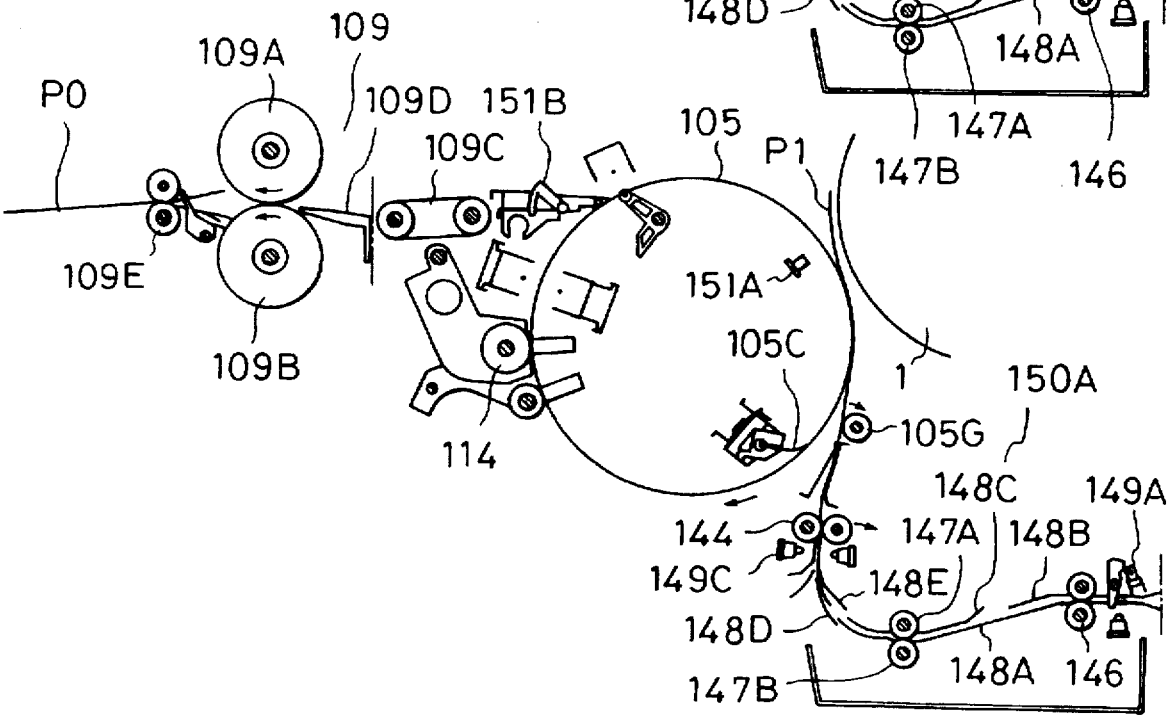

When jamming occurs in the transfer portion, as shown in FIGS. 14(*a*) and 14(*b*), i.e., when jamming is detected by the transfer portion jam detector 151A, it is presumed that the preceding recording sheet P0 before the jammed recording sheet P1 is transitioning between the transfer/conveyance unit 150 and the fixing unit 109. In this embodiment, although the conveyance belt 109C can be drawn out from the apparatus body together with the transfer/conveyance unit 150, the entrance guide 109D is left on the apparatus body side.

In this case, since the fixing unit 109 is driven independently of the transfer/conveyance unit 150, the recording sheet P0 can be removed by driving a pair of fixing rollers 109A and 109B after the transfer drum 105 is stopped, thereby removing the situation that the recording sheet P0 is placed over the transfer/conveyance unit 150 and the fixing unit 109. Since the length of the sheet path between the transfer portion jam detector 151A and the separation portion is substantially the same as the distance between recording sheets during continuous sheet feeding, the trailing end of the recording sheet P0 previously conveyed is conveyed to a position near the separation portion when jamming is detected in the transfer portion, and there is thus substantially no effect of attaching the recording sheet P0 to the transfer drum 105. Even if the recording sheet P0 is pulled by the fixing rollers 109A and 109B, there is no effect on the recording sheet holding sheet film 155S.

The above-described configuration in which a portion (the transfer/conveyance unit 150) for handling jam can be drawn out from the apparatus body permits the easy, reliable and safe jam handling work such as removal of the jammed sheet or the like, thereby decreasing the labor of the user.

In addition, when the transfer/conveyance unit 150 is drawn out from the apparatus body, the recording sheet placed in the course of conveyance within the apparatus is not broken and left in the apparatus. When the jammed sheet is removed, thus, the recording sheet holding sheet film 155S of the transfer drum 105 is less likely to be deformed or broken.

There is also no danger of damaging the surface of the photosensitive drum 101, as compared with the conventional work of removing the jammed recording sheet from the apparatus by hand.

Further, if the present invention is performed with the usual path, the length of the sheet path at least from the entrance of the conveyance portion 150A to the register rollers 144 must be greater than the maximum length of a recording sheet. However, a conveyance space for recording sheets used only at the time of occurrence of jamming may be provided for increasing the degree of freedom for design by shortening the sheet path on the upstream side of the register rollers 144 in the conveyance direction.

[Fifth Embodiment]

Figure 15A:
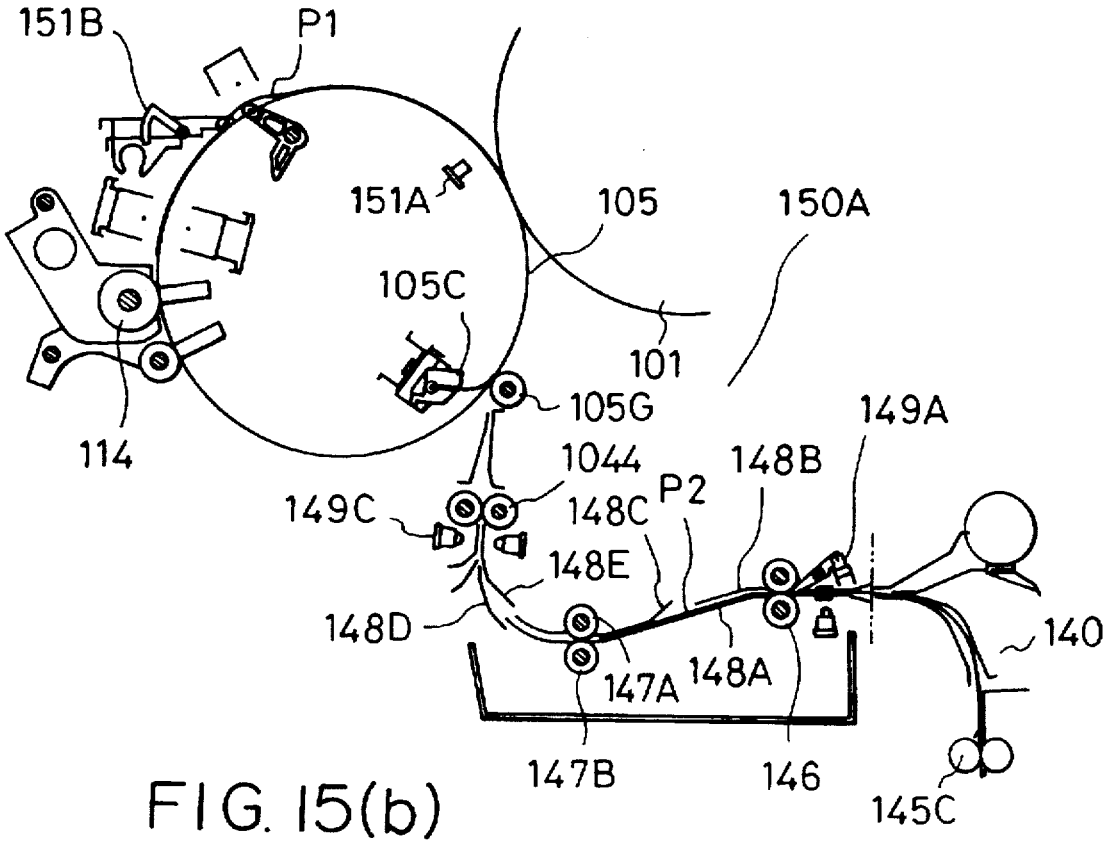
FIGS. 15(*a*) and 15(*b*) illustrate the operations of a sheet feeder unit and a conveyor portion of Embodiment 5 of the image forming apparatus of the invention when a sheet jam occurs in a separator portion.
Figure 15B:
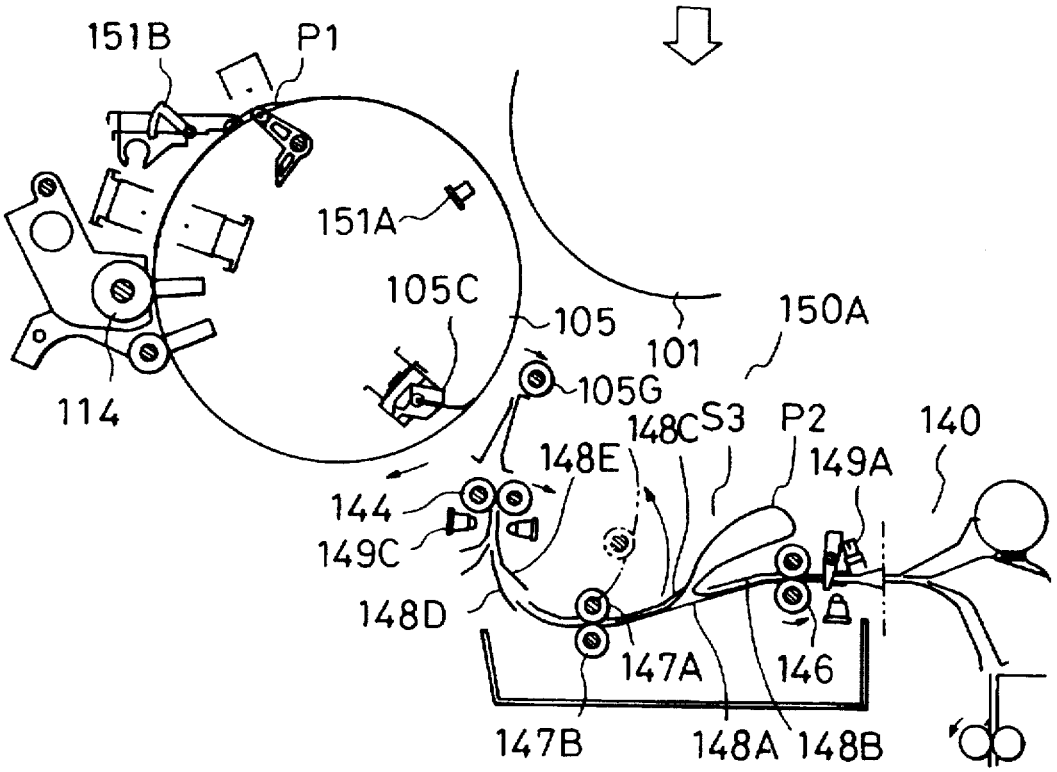
Figure 16:
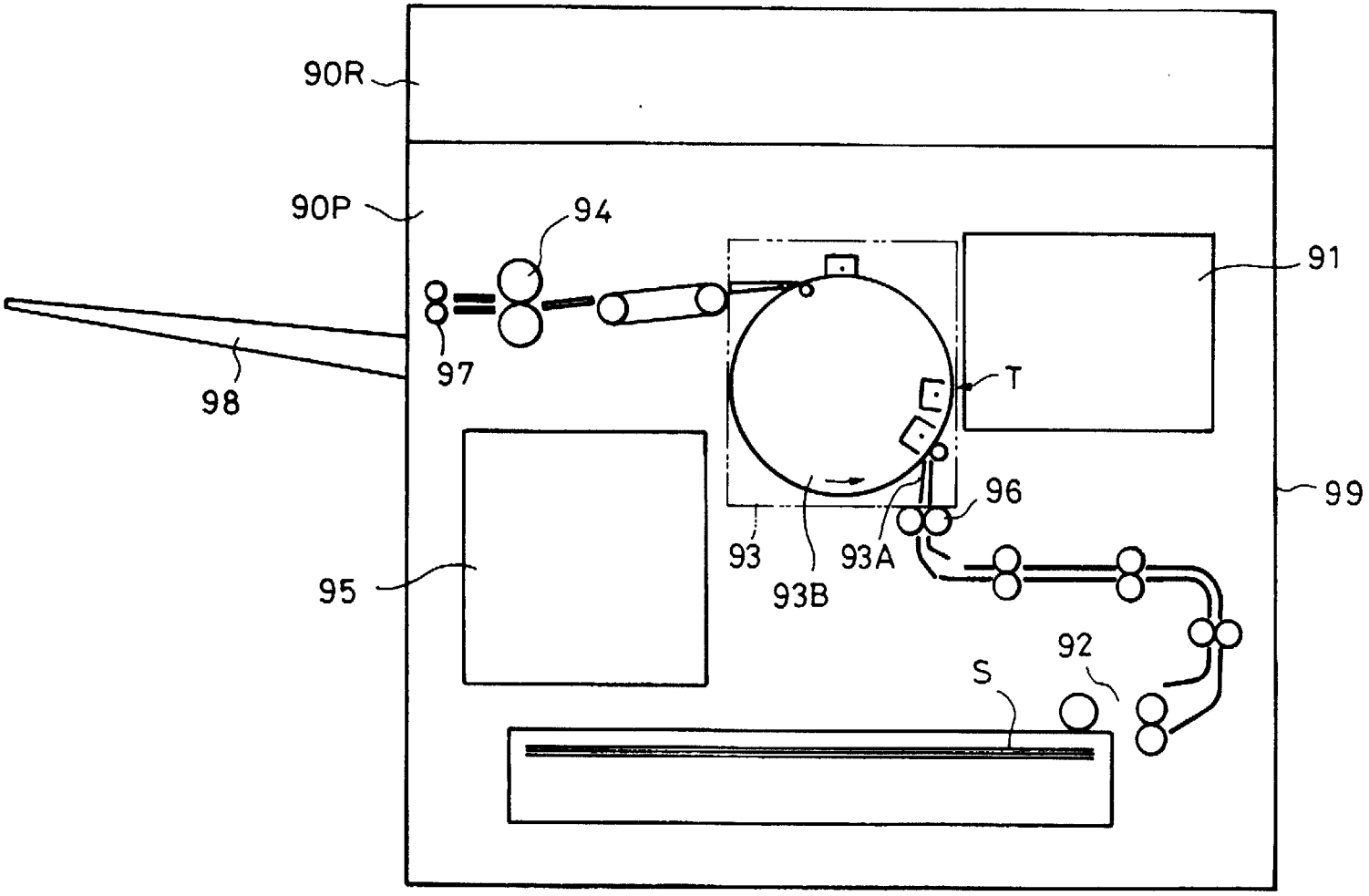
FIG. 16 illustrates the construction of a conventional image forming apparatus.

Another embodiment of the image forming apparatus according to the fourth embodiment is described below with reference to FIGS. 15(*a*) and (*b*). This embodiment relates to a jam handling sequence for further facilitating the work of jam clearance. Since the schematic configuration of the apparatus is the same as that of the fourth embodiment, the same members are denoted by the same reference numerals and are not described below.

The sequence for handling a jam in the separation portion is described with reference to FIG. 15. FIGS. 15(*a*) and (*b*) show the state wherein the recording sheet jams in the separation portion, and is similar to the state in the first embodiment shown in FIGS. 13(*a*) and (*b*). Namely, when separation jam is detected by the separation jam detector 151B, the transfer drum 105 and the register rollers 144 are immediately stopped. This embodiment differs from the fourth embodiment in that a pair of the conveyance rollers 147A and 147B are also simultaneously stopped. If it is decided by the recording sheet detection sensor 149A positioned near the entrance of the conveyance portion 150A that the recording sheet P2 is present, the other conveyance rollers 145C and 146 are rotated again. At this time, the leading end of the recording sheet P2 strikes on the nip portion between the conveyance roller pair 147A and 147B, and the recording sheet P2 then starts to form a loop.

In this embodiment, since a space S3 is provided between the conveyance guides 148B and 148C, the loop of the recording sheet P2 formed between the pair of the conveyance rollers 146 and the pair of the conveyance rollers 147A and 147B extends upward through the space S3. When the trailing end of the recording sheet P2 is detected by the recording sheet sensor 149A, the drive of the pairs of the conveyance rollers 145C and 146 is stopped (refer to FIG. 15). At this time, since the recording sheets P1 and the P2 are completely within the transfer/conveyance unit 150, the transfer/conveyance unit 150 can be drawn out without tearing the recording sheet P2. The subsequent operations of handling a jam and conveying the recording sheet are the same as those in the fourth embodiment.

In the above configuration, since the presence of the recording sheet P above the conveyance portion 150A can easily be confirmed when the transfer/conveyance unit 150 is drawn out, the recording sheet P2 can easily be removed by employing the loop of the recording sheet P2. In addition, since the recording sheet P2 does not deeply enter the sheet path, as compared with the case where the leading end of the recording sheet P2 is sent to a pair of the register rollers 144, the recording sheet P2 can be easily removed.

Although, in each of the fourth and fifth embodiments, the transfer drum 105 and the conveyance portion 150A are provided in the transfer/conveyance unit 150, a configuration in which the fixing portion is also provided in the transfer/conveyance portion can be used. This configuration has the advantage that the boundary between a portion drawn out from the apparatus body and a portion left in the apparatus body is between a pair of the delivery rollers 109E and the conveyance switching guide 119 (see FIG. 8). When recording sheet P4 is present at the boundary, the recording sheet P4 can thus be removed by outwardly (in the arrow direction) opening the delivery port (on the left of FIG. 8) of the apparatus body. There is thus no need for the special operation of independently rotating a pair of the fixing rollers 109A and 109B after the transfer drum 105 is stopped. The sequence for handling jam can thus be simplified, and the work of handling a jam by the user can further be facilitated.

Although each of the fourth and fifth embodiments uses the transfer drum 105 as means for conveying the recording sheet P to the image forming means, the conveyance means is not limited to this, and for example, an endless belt wound on a plurality of rollers may also be used.

In addition, the jam detection position is not limited to the transfer portion and the separation portion, and a jam detector may be provided at an appropriate position according to the apparatus.

Further, the image forming means is not limited to electrophotography, any other means such as the ink jet method, the heat transfer recording method and the like can be used in an apparatus which requires a recording sheet conveyance mechanism.

As described above, the image forming apparatus of the present invention comprises conveyance means, register means, and recording material holding/conveyance means, which can be separated as a unit from the apparatus body, and a first space which is provided in a portion of the conveyance means and which is required for conveying the recording material in a normal recording operation, and a second space provided for sending the recording material in an abnormal recording operation. The apparatus has the following effects:

(1) Since the portion for handling a jam can be drawn out as a unit from the apparatus body, the jam handling work such as removal of the jammed sheet or the like can be easily, securely and safely performed, thereby decreasing the labor of the user.

(2) When the unit is drawn out from the apparatus body, the recording material such as a recording sheet or the like, which is placed in the course of conveyance within the apparatus, is not broken and left in the apparatus. When the jammed sheet is removed, the recording material holding portion of the recording material holding/conveyance means (for example, the transfer drum) is thus hardly deformed or damaged.

(3) There is no danger of damaging the parts (for example, the photosensitive drum) of the image forming means, as compared with the conventional work of removing a recording sheet from the apparatus by hand.

(4) A conveyance space for the recording material used only when a jam occurs may be provided so that the degree of freedom for design can be increased by shortening the conveyance path on the upstream side of the register roller means in the conveyance direction.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet conveying apparatus for conveying sheets one by one, comprising:

a first conveyance path for guiding a sheet to be conveyed;

a second conveyance path arranged in continuation from said first conveyance path to guide said sheet;

supporting means for supporting said second conveyance path so as to allow said second conveyance path to move in a direction intersecting the direction of conveyance of said sheet; and jam detecting means for detecting a jam of said sheet at a detecting position, said detecting position being within said second conveyance path, and spaced from an inlet to said second conveyance path by a distance greater than a length of the sheet which has the greatest length among a group of sheets which are to be conveyed, as measured along said second conveyance path, wherein there is no other detecting position between said detecting position and said inlet of said second conveyance path, for detecting a jam of the sheet by another jam detecting means.

2. A sheet conveying apparatus according to claim 1, wherein said jam detecting means determines that the jamming has occurred upon detecting that a leading end of said sheet has not passed said detecting position within a predetermined time.

3. A sheet conveying apparatus according to claim 1, wherein said jam detecting means determines that the jamming has occurred upon detecting that a leading end of said sheet has not passed said detecting position after an elapse of a predetermined time following sheet passage by an upstream position upstream of said detecting position.

4. A sheet conveying apparatus according to claim 1, wherein the direction of movement of said second conveyance path is a horizontal direction.

5. A sheet conveying apparatus according to claim 1, further comprising:

first conveying means disposed proximate to the inlet of said second conveyance path, for receiving the sheet from said first conveyance path and conveying said sheet along said second conveyance path;

second conveying means disposed in said second conveyance path downstream of said first conveying means for conveying said sheet beyond said detecting position; and controlling means for controlling said first and second conveying means such that when said jam detecting means has detected the jam of said sheet at said detecting position, said second conveying means is stopped while said first conveying means operates until a trailing end of said sheet passes the inlet of said second conveyance path.

6. A sheet conveying apparatus according to claim 5, wherein said jam detecting means determines that the jam has occurred upon detecting that a leading end of said sheet has not passed said detecting position after passage of a predetermined time.

7. A sheet conveying apparatus according to claim 5, wherein said jam detecting means determines that the jam has occurred upon detecting that a leading end of said sheet has not passed said detecting position after passage of a predetermined time from sheet passage by an upstream position upstream of said detecting position.

8. A sheet conveying apparatus according to claim 7, further comprising sheet detecting means for detecting presence of said sheet at a position proximate to the inlet of said second conveyance path, wherein, when said sheet detecting means detects a presence of said sheet after said jam detecting means has determined that a jam has occurred, said controlling means causes said first conveying means to operate until said sheet detecting means fails to detect the presence of the sheet.

9. A sheet conveying apparatus according to claim 5, wherein said controlling means causes said second conveying means to operate for a predetermined period after a jam is detected at said detecting position by said jam detecting means.

10. An image forming apparatus including a sheet conveying apparatus for conveying sheets one by one, comprising:

a first conveyance path for guiding a sheet to be conveyed;

a second conveyance path arranged in continuation from said first conveyance path to guide said sheet;

a conveyor drum for retaining said sheet on its surface and conveying said sheet such that said sheet moves along a part of said second conveyance path;

image forming means for forming an image on said sheet retained by said conveyor drum;

supporting means for supporting said drum and said second conveyance path so as to allow said drum and said second conveyance path to move in a direction intersecting the direction of conveyance of said sheet; and jam detecting means for detecting a jam of said sheet at a detecting position, said detecting position being on said drum and spaced from an inlet to said second conveyance path by a distance greater than a length of the sheet which has the greatest length among a group of sheets which are to be conveyed, as measured along said second conveyance path, wherein there is no other detecting position between said detecting position and said inlet of said second conveyance path, for detecting a jam of the sheet by another jam detecting means.

11. An image forming apparatus according to claim 10, wherein said jam detecting means determines that the jam has occurred upon detecting that a leading end of said sheet has not passed said detecting position within a predetermined timing.

12. An image forming apparatus according to claim 10, wherein said jam detecting means determines that the jam has occurred upon detecting that a leading end of said sheet has not passed said detecting position after an elapse of a predetermined time following sheet passage by an upstream position upstream of said detecting position.

13. An image forming apparatus according to claim 10, wherein the direction of movement of said second conveyance path is a horizontal direction.

14. An image forming apparatus according to claim 10, wherein a distance between the inlet of said second conveyance path and said detecting position as measured along said second conveyance path is smaller than a circumferential length of said drum.

15. An image forming apparatus according to claim 10, further comprising:

conveying means disposed proximate to the inlet of said second conveyance path, for receiving the sheet from said first conveyance path and conveying said sheet along said second conveyance path; and controlling means for controlling said drum and said conveying means such that when said jam detecting means has detected a jam of a sheet at said detecting position, said drum is stopped while said conveying means operates until a trailing end of said sheet passes the inlet of said second conveyance path.

16. A sheet conveying apparatus comprising:

a first conveyance path for guiding a sheet to be conveyed;

a second conveyance path arranged in continuation from said first conveyance path to guide said sheet;

supporting means for supporting said second conveyance path so as to allow said second conveyance path to move in a direction intersecting the direction of conveyance of said sheet;

jam detecting means for detecting a jam of said sheet at a detecting position, said detecting position being within said second conveyance path;

first conveying means disposed proximate to the inlet of said second conveyance path, for receiving the sheet from said first conveyance path and conveying said sheet along said second conveyance path;

second conveying means, disposed in said second conveyance path downstream of said first conveying means, for conveying said sheet beyond said detecting position;

controlling means for controlling said first and second conveying means such that when said jam detecting means has detected a jam of a sheet at said detecting position, said second conveying means is stopped while said first conveying means operates until a trailing end of said sheet passes the inlet of said second conveyance path; and a space adjacent to said second conveyance path, for accommodating bulging of said sheet between said first conveying means and said second conveying means.

17. A sheet conveying apparatus according to claim 16, wherein said jam detecting means determines that the jam has occurred upon detecting that the leading end of said sheet has not passed said detecting position within a predetermined time.

18. A sheet conveying apparatus according to claim 17, wherein said jam detecting means determines that the jamming has occurred upon detecting that the leading end of said sheet has not passed said detecting position after an elapse of a predetermined time following sheet passage by an upstream position upstream of said detecting position.

19. A sheet conveying apparatus according to claim 16, wherein the direction of movement of said second conveyance path is a horizontal direction.

20. A sheet conveying apparatus according to claim 16, wherein said second conveyance path includes a guide for guiding a sheet and said space is formed by a movement of said guide in such a direction as to expand said second conveyance path.

21. An image forming apparatus including a sheet conveying apparatus for conveying sheets one by one, comprising:

a first conveyance path for guiding a sheet to be conveyed;

a second conveyance path arranged in continuation from said first conveyance path to guide said sheet;

supporting means for supporting said second conveyance path so as to allow said second conveyance path to move in a direction intersecting the direction of conveyance of said sheet;

jam detecting means for detecting a jam of said sheet at a detecting position, said detecting position being within said second conveyance path and spaced from an inlet to said second conveyance path by a distance greater than a length of the sheet which has the greatest length among a group of sheets which are to be conveyed, as measured along said second conveyance path, wherein there is no other detecting position between said detecting position and said inlet of said second conveyance path, for detecting a jam of the sheet by another jam detecting means; and image forming means for forming an image on the sheet guided along said second conveyance path.

22. An image forming apparatus comprising:

a first conveyance path for guiding a sheet to be conveyed;

a second conveyance path arranged in continuation from said first conveyance path to guide said sheet;

supporting means for supporting said second conveyance path so as to allow said second conveyance path to move in a direction intersecting the direction of conveyance of said sheet;

jam detecting means for detecting a jam of said sheet at a detecting position, said detecting position being within said second conveyance path;

first conveying means disposed proximate to the inlet of said second conveyance path, for receiving the sheet from said first conveyance path and conveying said sheet along said second conveyance path;

second conveying means, disposed in said second conveyance path downstream of said first conveying means, for conveying said sheet beyond said detecting position;

controlling means for controlling said first and second conveying means such that when said jam detecting means has detected a jam of a sheet at said detecting position, said second conveying means is stopped while said first conveying means operates until a trailing end of said sheet passes the inlet of said second conveyance path;

a space adjacent to said second conveyance path, for accommodating bulging of said sheet between said first conveying means and said second conveying means; and image forming means for forming an image on the sheet guided along said second conveyance path.

23. A sheet conveying apparatus for conveying sheets one by one, comprising:

a first conveyance path for guiding a sheet to be conveyed;

a second conveyance path arranged in continuation from said first conveyance path to guide said sheet;

supporting means for supporting said second conveyance path so as to allow said second conveyance path to move in a direction intersecting the direction of conveyance of said sheet; and jam detecting means for detecting a conveyance failure of said sheet at said second conveyance path, wherein said jam detecting means determines that the conveyance failure has occurred upon detecting that a leading end of said sheet has not passed a detecting position after an elapse of a predetermined time following sheet passage by an upstream position upstream of said detecting position, said detecting position being within said second conveyance path and spaced from an inlet to said second conveyance path by a distance greater than a length of which has the greatest length among a group of sheets which are to be conveyed, as measured along said second conveyance path, wherein there is no other detecting position between said detecting position and said inlet of said second conveyance path, for detecting a jam of the sheet by another jam detecting means.

24. A sheet conveying apparatus according to claim 23, further comprising:

first conveying means disposed proximate to the inlet of said second conveyance path, for receiving the sheet from said first conveyance path and conveying said sheet along said second conveyance path;

second conveying means disposed in said second conveyance path downstream of said first conveying means for conveying said sheet beyond said detecting position; and controlling means for controlling said first and second conveying means such that when said jam detecting means has detected the conveyance failure of said sheet, said second conveying means is stopped while said first conveying means operates until a trailing end of said sheet passes the inlet of said second conveyance path.

25. A sheet conveying apparatus according to claim 24, further comprising:

a sheet detecting means for detecting the passage of a trailing end of said sheet by said inlet, wherein said controlling means stops the operation of said first conveying means after the detection of said sheet detecting means.

26. A sheet conveying apparatus according to claim 23, further comprising image forming means for forming an image on the sheet guided along said second conveyance path.

27. A sheet conveying apparatus for conveying sheets one by one, comprising:

a first conveyance path for guiding a sheet to be conveyed;

a second conveyance path arranged in continuation from said first conveyance path to guide said sheet;

supporting means for supporting said second conveyance path so as to allow said second conveyance path to move in a direction intersecting the direction of conveyance of said sheet;

first conveying means disposed proximate to an inlet of said second conveyance path, for receiving the sheet from said first conveyance path and conveying said sheet along said second conveyance path to a detecting position;

second conveying means disposed in said second conveyance path downstream of said first conveying means for conveying said sheet beyond said detecting position;

first detecting means for detecting a conveyance failure of said sheet at said second conveying means;

a second detecting means for detecting the passage of a trailing end of said sheet by an inlet of said second conveyance path; and controlling means for controlling said first and second conveying means such that when said first detecting means has detected the conveyance failure of said sheet, said second conveying means is stopped while said first conveying means operates, and that said first conveying means is stopped after said second detecting means detects the passage of a trailing end of said sheet by said inlet.

28. A sheet conveying apparatus according to claim 27, further comprising image forming means for forming an image on a sheet guided along said second conveyance path.

29. An image forming apparatus including sheet conveying apparatus for conveying sheets one by one, comprising:

a first conveyance path for guiding a sheet to be conveyed;

a second conveyance path arranged in continuation from said first conveyance path to guide said sheet;

supporting means for supporting said second conveyance path so as to allow said second conveyance path to move in a direction intersecting the direction of conveyance of said sheet;

jam detecting means for detecting a jam of said sheet at a detecting position, said detecting position being within said second conveyance path and spaced from an inlet to said second conveyance path by a distance greater than a length of the sheet which has the greater length among a group of sheets which are to be conveyed, as measured along said second conveyance path, wherein there is no other detecting position between said detecting position and said inlet of said second conveyance path, for detecting a jam of the sheet by another jam detecting means; and image forming means for forming an image on the sheet guided along said second conveyance path, said image forming means having a photosensitive drum, latent image forming means for forming an electrostatic latent image on said photosensitive drum, a developing means for developing the electrostatic latent image on said photosensitive drum into a visible image using plural kinds of color toner and a transfer means for transferring the toner image on said photosensitive drum onto a sheet guided by said first conveyance path.

30. An image forming apparatus according to claim 29, wherein said jam detecting means determines that the jamming has occurred upon detecting that a leading end of said sheet has not passed said detecting position within a predetermined time.

31. An image forming apparatus according to claim 29, wherein the jam detecting means determines that the jamming has occurred upon detecting that a leading end of said sheet has not passed said detecting position after an elapse of a predetermined time following sheet passage by an upstream predetermined position upstream of said detecting position.

32. An image forming apparatus according to claim 29, wherein the direction of movement of said second conveyance path is a horizontal direction.

33. An image forming apparatus according to claim 29, further comprising:

first conveying means disposed proximate in the inlet of said second conveyance path, for receiving the sheet from said first conveyance path and conveying said sheet along said second conveyance path;

second conveying means disposed in said second conveyance path downstream of said first conveying means for conveying said sheet beyond said detecting position; and controlling means for controlling said first and second conveying means such that when said jam detecting means has detected the jam of said sheet at said detecting position, said second conveying means is stopped while said first conveying means operates until a trailing end of said sheet passes the inlet of said second conveyance path.

34. An image forming apparatus according to claim 33, wherein said jam detecting means determines that the jam has occurred upon detecting that a leading end of said sheet has not passed said detecting position after passage of a predetermined time.

35. An image forming apparatus according to claim 33, wherein said controlling means causes said first conveying means to operate for a predetermined period after a jam is detected at said detecting position by said jam detecting means.

36. An image forming apparatus according to claim 33, wherein said jam detecting means determines that the jam has occurred upon detecting that a leading end of said sheet has not passed said detecting position after passage of a predetermined time from sheet passage by an upstream position upstream of said detecting position.

37. An image forming apparatus according to claim 36, further comprising sheet detecting means for detecting a presence of said sheet at an inlet position proximate to the inlet of said second conveyance path, wherein, when said sheet detecting means detects a presence of said sheet after said jam detecting means has determined that a jam has occurred, said controlling means causes said first conveying means to operate until said sheet detecting means fails to detect the presence of the sheet.

38. An image forming apparatus comprising:

a first conveyance path for guiding a sheet to be conveyed;

a second conveyance path arranged in continuation from said first conveyance path to guide the sheet;

conveying means for conveying the sheet along said second conveyance path;

supporting means for supporting said second conveyance path to move in a direction intersecting the direction of conveyance of said sheet;

a detector for detecting the sheet at a first predetermined position within said second conveyance path, wherein the length of a path between said first predetermined position and an inlet of said second conveyance path is greater than a length of the sheet which has the greatest length among a group of sheets which are to be conveyed, as measured along said second conveyance path;

controlling means for controlling said conveying means such that when said detector has not detected the sheet after a predetermined time following sheet passage by a second predetermined position upstream of said first predetermined position, said conveying means is stopped, wherein there is no other detector between said detector and said inlet of said second conveyance path, for detecting the sheet; and image forming means for forming an image on the sheet guided along said second conveyance path.

39. An image forming apparatus according to claim 38, further comprising:

a third conveyance path for guiding the sheet on which an image is formed by said image forming means to said first conveyance path, wherein said sheet guided by said third conveyance path is guided by said first and second conveyance paths so that said image forming means forms a second image on said sheet guided by said third conveyance path.

40. An image forming apparatus according to claim 38, said image forming means comprising:

a photosensitive drum;

latent image forming means for forming an electrostatic latent image on said photosensitive drum;

developing means for developing the electrostatic latent image on said photosensitive drum into a visible image using plural kinds of color toner; and transfer means for transferring the toner image on said photosensitive drum onto a sheet guided by said second conveyance path.

41. An image forming apparatus according to claim 38, said conveying means comprising a conveyor drum for retaining the sheet on its surface and for conveying the sheet along said second conveyance path.

42. An image forming apparatus according to claim 41, wherein said image forming means forms an image on the sheet retained by said conveyer drum.

43. An image forming apparatus according to claim 42, further comprising:

a third conveyance path for guiding the sheet on which an image is formed by said image forming means to said first conveyance path, wherein said sheet guided by said third conveyance path is guided by said first and second conveyance paths so that said image forming means forms a second image on said sheet guided by said third conveyance path.

44. An image forming apparatus according to claim 43, wherein said image forming means comprising:

a photosensitive drum;

latent image forming means for forming an electrostatic latent image on said photosensitive drum;

developing means for developing the electrostatic latent image on said photosensitive drum into a visible image using plural kinds of color toner; and transfer means for transferring the toner image on said photosensitive drum onto a sheet retained by said conveyer drum.

45. An image forming apparatus comprising:

a first conveyance path for guiding a sheet to be conveyed;

a conveying means for conveying a sheet along said first conveyance path;

a second conveyance path arranged in continuation from said first conveyance path for guiding the sheet guided by said first conveyance path;

a conveyor drum for retaining said sheet on its surface and conveying said sheet such that said sheet moves along said second conveyance path;

image forming means for forming an image on said sheet conveyed by said conveyor drum;

supporting means for supporting said drum and said second conveyance path so as to allow said drum and said second conveyance path to move in a direction intersecting the direction of conveyance of said sheet;

separating means for separating the sheet retained by said conveyor drum from said drum;

jam detecting means for detecting a jam of said sheet at a detecting position, said detecting position being on said second conveyance path and downstream of said separating means;

wherein said detecting position is spaced from an outlet of said second conveyance path by a distance smaller than a length of the gap between successive sheets continuously conveyed by said conveying means.

46. An image forming apparatus according to claim 45, wherein said jam detecting means determines that the jam has occurred upon detecting that a leading end of said sheet has not passed said detecting position after an elapse of a predetermined time following sheet passage by an upstream position of said detecting position.

47. An image forming apparatus according to claim 46, wherein said detecting position is spaced from an inlet of said second conveyance path by a distance greater than a length of the longest sheet which has the greatest length among sets of sheets which are to be conveyed as measured along said second conveyance path.

48. An image forming apparatus according to claim 46, wherein said jam detecting means determines that the jam has occurred upon detecting that a leading end of said sheet has not passed said detecting position after an elapse of a predetermined time following sheet passage by an upstream position of said detecting position.

49. An image forming apparatus comprising:

a first conveyance path for guiding a sheet to be conveyed;

a conveying means for conveying a sheet along said first conveyance path;

a second conveyance path arranged in continuation from said first conveyance path for guiding the sheet guided by said first conveyance path;

a conveyor drum for retaining said sheet on its surface and conveying said sheet such that said sheet moves along said second conveyance path;

image forming means for forming an image on said sheet conveyed by said conveyor drum;

supporting means for supporting said drum and said second conveyance path so as to allow said drum and said second conveyance path to move in a direction intersecting the direction of conveyance of said sheet; and jam detecting means for detecting a jam of said sheet at a detecting position, said detecting position being within said second conveyance path;

wherein said detecting position is spaced from an inlet of said second conveyance path by a distance smaller than the sum of a length of the longest sheet which has the greatest length among a group of sheets which are to be conveyed as measured along said second conveyance path, and a length of the gap between successive sheets continuously conveyed by said conveying means, and wherein there is no other detecting position between said detecting position and said inlet of said second conveyance path, for detecting a jam of the sheet by another jam detecting means.

* * * * *

UNITED STATES PATENT AND TRADEMARK OFFICE

CERTIFICATE OF CORRECTION

PATENT NO. : 5,893,657

DATED : April 13, 1999

INVENTOR(S) : KUNIHIKO MATSUZAWA

It is certified that error appears in the above-identified patent and that said Letters Patent is hereby corrected as shown below:

COVER PAGE [56] U.S. PATENT DOCUMENTS,
Insert --4,327,366 4/1982 Schafter, et al. 347/220, 4,350,987 9/1982 Hanagata, et al. 347,218, 4,379,646 4/1983 Maeda 400/636, 4,384,712 5/1983 Miyamoto 271/261, and 4,475,825 10/1984 Hashimoto 400/120.01--.

COLUMN 2,
Line 17, "of" should read --of the--.

COLUMN 5,
Line 41, "drum" should read --drum 11.--.

COLUMN 6,
Line 31, "sitve" should read --sitive--; and
Line 49, "30R" should read --50R--.

COLUMN 7,
Line 61, "photosensitve" should read --photosensitive--.

COLUMN 10,
Line 8, "photosensitve" should read --photosensitive--.

COLUMN 17,
Line 27, "fro" should read --from--; and
Line 30, "105 being" should read --105 from being--.

UNITED STATES PATENT AND TRADEMARK OFFICE

CERTIFICATE OF CORRECTION

PATENT NO. : 5,893,657

DATED : April 13, 1999

INVENTOR(S) : KUNIHIKO MATSUZAWA

It is certified that error appears in the above-identified patent and that said Letters Patent is hereby corrected as shown below:

COLUMN 18,
Line 63, "is" (2nd occurrence) should be deleted; and
Line 66, "is" should read --are--.

COLUMN 23,
Line 53, "the" (2nd occurrence) should be deleted.

COLUMN 31,
Line 60, "said" should read --wherein said--.

COLUMN 32,
Line 10, "conveyer" should read --conveyor--; and
Line 31, "conveyer" should read --conveyor--.

Signed and Sealed this
Fourth Day of January, 2000

*Attest:*

*Attesting Officer*

*Acting Commissioner of Patents and Trademarks*